US009784053B2

(12) United States Patent
Magnuson

(10) Patent No.: US 9,784,053 B2
(45) Date of Patent: Oct. 10, 2017

(54) MOUSEHOLE TUBULAR RETENTION SYSTEM

(71) Applicant: Nabors Industries, Inc., Houston, TX (US)

(72) Inventor: Christopher Magnuson, Houston, TX (US)

(73) Assignee: Nabors Industries, Inc., Houston, TX (US)

( * ) Notice: Subject to any disclaimer, the term of this patent is extended or adjusted under 35 U.S.C. 154(b) by 344 days.

(21) Appl. No.: 14/565,847

(22) Filed: Dec. 10, 2014

(65) Prior Publication Data

US 2016/0168928 A1 Jun. 16, 2016

(51) Int. Cl.
*E21B 19/02* (2006.01)
*E21B 19/10* (2006.01)

(52) U.S. Cl.
CPC ..... *E21B 19/10* (2013.01)

(58) Field of Classification Search
CPC ..... E21B 19/10
USPC ..... 166/244.1
See application file for complete search history.

(56) References Cited

U.S. PATENT DOCUMENTS 4,511,168 A * 4/1985 Haynes ..... E21B 19/07 188/67
7,832,470 B2 11/2010 Anthony
8,733,472 B2 5/2014 Magnuson
9,051,782 B2 6/2015 Magnuson
9,354,623 B2 5/2016 Magnuson
9,394,751 B2 7/2016 Magnuson
2008/0202813 A1* 8/2008 Anthony ..... E21B 19/10 175/52
2012/0067642 A1 3/2012 Magnuson
2013/0220637 A1* 8/2013 Fabela ..... E21B 19/10 166/382
2013/0248205 A1* 9/2013 Angelle ..... E21B 19/07 166/380
2014/0202769 A1 7/2014 Magnuson
2014/0216815 A1 8/2014 Magnuson
2015/0086718 A1 3/2015 Magnuson et al.
2015/0090463 A1 4/2015 Gupta et al.
2015/0096764 A1 4/2015 Magnuson et al.
(Continued)

FOREIGN PATENT DOCUMENTS

CN 2213836 Y 11/1995

*Primary Examiner* — Taras P Bemko
(74) *Attorney, Agent, or Firm* — Haynes and Boone, LLP

(57) ABSTRACT

The systems, devices, and methods described herein describe a tubular retention system arranged over a mousehole. The tubular retention system includes load bearing plates that are mutually opposed, vertically aligned, and connected to an eternal support structure via upper and lower links that, together, form a parallelogram shape movable to engage tubulars of varying diameters. The load bearing plates are pulled down by a biasing system to engage the tubular and synchronized by a lifting ring connecting the load bearing plates together. Mutually opposing deflector plates are connected to the load bearing plates and move in response to the downward movement of the load bearing plates, providing a centering force against the tubular to assure proper retention once the load bearing links engage the tubular. An upward force enables the load bearing plates to return upward and outward to release the tubular.

20 Claims, 16 Drawing Sheets

(56) References Cited

U.S. PATENT DOCUMENTS

| | | | |
|---|---|---|---|
| 2015/0101826 | A1 | 4/2015 | Gupta et al. |
| 2015/0232272 | A1 | 8/2015 | Magnuson |
| 2015/0330162 | A1 | 11/2015 | Magnuson et al. |
| 2016/0060979 | A1 | 3/2016 | Magnuson |
| 2016/0060980 | A1 | 3/2016 | Magnuson |
| 2016/0168928 | A1 | 6/2016 | Magnuson |
| 2016/0168929 | A1 | 6/2016 | Magnuson et al. |
| 2016/0251869 | A1 | 9/2016 | Deel et al. |
| 2016/0319610 | A1 | 11/2016 | Magnuson |

* cited by examiner

MOUSEHOLE TUBULAR RETENTION SYSTEM

TECHNICAL FIELD

The present disclosure is directed to systems, devices, and methods for supporting tubulars at a drilling rig. More specifically, the present disclosure is directed to systems, devices, and methods for supporting tubulars over a mousehole during stand assembly/disassembly.

BACKGROUND OF THE DISCLOSURE

The exploration and production of hydrocarbons require the use of numerous types of tubulars also referred to as pipe. Tubulars include, but are not limited to, drill pipes, casings, tubing, Riser and other threadably connectable elements used in well structures. The connection of "strings" of joined tubulars or drill strings is often used to drill a wellbore and, with regards to casing, prevent collapse of the wellbore after drilling. These tubulars are normally assembled in groups of two or more commonly known as "stands" to be vertically stored in the derrick or mast. The derrick or mast may include a storing structure commonly referred to as a fingerboard. Fingerboards typically include a plurality of horizontally elongated support structures or "fingers" each capable of receiving a plurality of stands.

Rotary drilling and top drive drilling systems often use these stands, instead of single tubulars, to increase efficiency of drilling operations by reducing the amount of connections required to build the drill string in or directly over the wellbore. In order to assemble these tubulars into stands, individual tubulars may be joined using an offline "mousehole" in the rig floor. Typically, slips designed for rotary tables are used at the mousehole to grasp and hold individual tubulars as they are threaded together to make a stand. These slips require rig personnel (sometimes two to three) to manually pick up and place them in the mousehole around the drill pipe to facilitate the make-up of the stands. These slips are bulky and must be top-mounted.

Other slips have been used as dedicated mousehole slips, thereby removing the need to manually pick up and move them between the mousehole and well center. However, these dedicated mousehole slips incorporate standard slips that are designed to hold hundreds of tons, although any slip at the mousehole would likely need to support no more than 10 tons. Further, many slips still require removal and insertion of different wedges in the bowl of the slip to deal with tubulars of different diameters, which takes additional time and energy.

The present disclosure is directed to systems and methods that overcome one or more of the shortcomings of the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
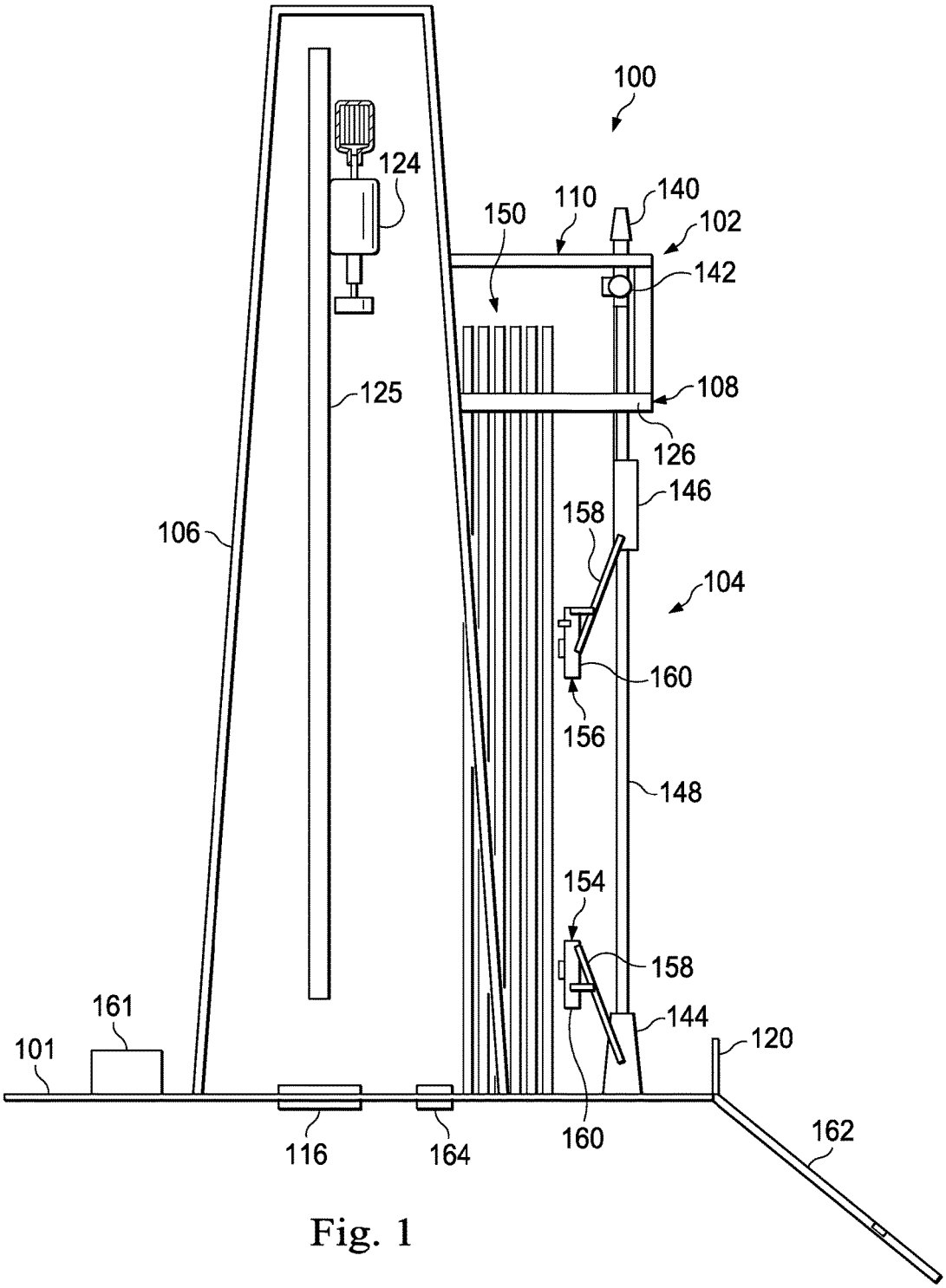
FIG. 1 is a schematic of an exemplary drilling rig according to one or more aspects of the present disclosure.

It is to be understood that the following disclosure provides many different embodiments, or examples, for implementing different features of various embodiments. Specific examples of components and arrangements are described below to simplify the present disclosure. These are merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The systems, devices, and methods described herein describe a drilling rig apparatus that includes a tubular retention system structurally arranged, for example at a mousehole, to retain a tubular during make up or take down of a stand. Unlike conventional slips, the tubular retention system includes multiple load bearing plates that are mutually opposed and vertically aligned with a tubular. These load bearing plates are connected to an external support structure via upper and lower links that, together, form a parallelogram shape that is movable to engage tubulars of varying diameters. The load bearing plates are pulled down by a biasing system (which can include actuators and/or a biasing element) to engage the tubular, which downward motion may be synchronized by a lifting ring connecting the load bearing plates together. Multiple deflector plates that are similarly mutually opposed like the load bearing plates are connected to the load bearing plates and move in response to the downward movement of the load bearing plates. As the deflector plates move downward and their lower sections inward, they provide a centering force against the tubular to assure proper retention once the load bearing links engage the tubular.

FIG. 1 is a schematic of a side view an exemplary drilling rig 100 according to one or more aspects of the present disclosure. In some examples, the drilling rig 100 may form a part of a land-based, mobile drilling rig. The drilling rig 100 may have a drillfloor size of about 35×35 feet, although larger and smaller rigs are contemplated. In some embodiments, the drilling rig 100 may have a drillfloor size of less than approximately 1600 square feet. In other embodiments, the drilling rig 100 may have a drillfloor size of less than approximately 1200 square feet.

The drilling rig 100 shown in FIG. 1 includes a rig floor 101 with rig-based structures and supports 102 and a racker device 104 that operates on the rig-based structures and supports 102. The rig-based structures and supports 102 include, for example, a mast 106, a fingerboard 108, a racker carriage track structure 110, and a v-door 120 into the drilling rig 100. The v-door 120 may be arranged to receive tubulars or stands introduced to the drilling rig 100. The fingerboard 108 may include a fingerboard frame 126 that supports and carries fingers (not shown in FIG. 1) that define openings therebetween for receiving tubular stands. The racker device 104 may move from the position shown toward the mast 106 and may transfer tubulars between the v-door 120, the fingerboard 108, and well-center 116, or other location, such as off-line mousehole 164, disposed about the rig floor 101. In an embodiment, the mast 106 is disposed over and about well-center 116 and supports a plurality of drilling components of a drilling system, shown here as a top drive 124 and its components disposed and moveable along a support column 125. Other drilling components are also contemplated.

The offline mousehole 164 may be used to assemble tubulars into stands at a location spaced apart from the well-center 116 so as to not interfere with drilling at the well-center 116. In some embodiments, the mousehole 164 is located above a shallow hole that is offline from well-center 116, where individual tubulars may be assembled together into stands, e.g. a plurality, such as three tubulars together that are then racked in the fingerboard 108 by the racker device 104. According to embodiments of the present disclosure discussed in more detail below with respect to FIGS. 3-10, a tubular retention system may be placed at the mousehole 164 to retain tubulars while they are assembled manually or by an iron roughneck.

In FIG. 1, the racker device 104 may include a racker upper drive carriage 140, a modular racker hoist 142, a lower drive carriage 144, an upper column drive 146, and a racker support column 148. Drill pipe stands 150 are shown in FIG. 1 and may be transferred by the racker device 104 on the rig based structures and supports 102 into and out of the fingerboard 108, and transferred into or out of the well-center 116 or the mousehole 164. The racker support column 148 may be formed of a single beam or multiple beams joined together. In some embodiments, the racker support column 148 is a structural support along which the column drive 146 may move upward or downward on rollers, slide pads, or other elements.

In an exemplary embodiment, the upper drive carriage 140 is configured to move the upper portion of the racker support column 148 along the racker carriage track structure 110. The upper drive carriage 140 may include rollers, sliding pads, or other structure that facilitates it moving, along with the racker device 104 of which it is a part, between the v-door 120, mousehole 164, and well center 116 below the mast 106. In some embodiments, the upper drive carriage 140 is a part of a chain structure that drives the racker device 104 along a passageway formed to accommodate the racker device 104 through the fingerboard 108. In addition, it may cooperate with or may include the racker hoist 142 and may be configured to operate the racker hoist 142 to raise and lower the upper column drive 146 along the racker support column 148. That is, the racker hoist 142 may be in operable engagement with the upper drive carriage 140 and may be driven by the upper drive carriage 140. It moves the upper column drive 146 up or down in a vertical direction along the racker support column 148.

The lower drive carriage 144 and the upper column drive 146 may cooperate to manipulate tubulars and/or stands. In this embodiment, the lower drive carriage 144 includes a drive system that allows the lower drive carriage 144 to displace along the rig floor 101. In some embodiments, this occurs along rails, tracks, or other defined pathway. The upper column drive 146 and the lower drive carriage 144 respectively include racker arms, referenced herein as a lower tubular interfacing element 154 and an upper tubular interfacing element 156. Each includes a manipulator arm 158 and a gripper head 160. The gripper heads 160 may be sized and shaped to open and close to grasp or retain tubing, such as tubulars or stands. The manipulator arms 158 may move the gripper heads 160 toward and away from the racker support column 148.

These upper and lower tubular interfacing elements 156, 154 are configured to reach out to insert a drill pipe stand into or remove a drill pipe stand from fingerboard 108. That is, the upper and lower tubular interfacing elements 156, 154 extend outwardly from the racker support column 148 to clamp onto or otherwise secure a drill pipe stand that is in the fingerboard 108 or to place a drill pipe stand in the fingerboard. In addition, the upper and lower tubular interfacing elements 156, 154 are configured to reach out to receive tubulars introduced to the drilling rig 100 through the v-door 120 and to carry tubulars or stands from the v-door 120 or the fingerboard 108 to the mousehole 164 or to the well-center 116 for hand-off to the drilling elements, such as the top drive 124. As indicated above, the column drive 146 may move vertically up and down along the racker support column 148. In some aspects, it is operated by the hoist 142.

A rig control system 161 may control the racker device 104 and other rig components, while also communicating with sensors disposed about the drilling rig 100. The rig control system 161 may evaluate data from the sensors, evaluate the state of wear of individual tubulars or stands, and may make recommendations regarding validation of tubulars for a particular use as a part of a drilling operation. In some embodiments, the rig control system 161 may be disposed on the rig 101, such as in a driller's cabin, may be disposed in a control truck off the rig 101, or may disposed elsewhere about the drilling site. In some embodiments, the rig control system 161 is disposed remote from the drilling site, such as in a central drill monitoring facility remote from the drill site.

A catwalk 162 forms a part of the drilling rig 100 and may be directly attached to or disposed adjacent the rig floor 101. The catwalk 162 allows the introduction of drilling equipment, and in particular tubulars or stands, to the v-door 120 of the drilling rig 100. In some embodiments, the catwalk 162 is a simple, solid ramp along which tubulars may be pushed or pulled until the tubular can be grasped or secured by the upper tubular interfacing element 106 of the racker device 104. In other embodiments, the catwalk 162 is formed with a conveyer structure, such as a belt-driven conveyer that helps advance the tubulars toward or away from the drilling rig 100. Other embodiments include friction reducing elements, such as rollers, bearings, or other structure that enables the tubulars to advance along the catwalk toward or away from the v-door 120. It should be noted that where land rigs utilize catwalks, offshore rigs utilize conveyors to transport tubulars from the pipe deck to the rig floor 101. Therefore, it should be understood that description of the present disclosure use in a land rig may also be utilized in an offshore rig.

Embodiments of the present disclosure may also include a sensing arrangement (not shown) disposed about the drilling rig structure that detects aspects of a tubular or stand. These sensed aspects represent information that may be used to determine specification characteristics of a tubular, such as lengths and weight for example, usable to validate the technical specifications of the tubulars. In the embodiments described herein, the sensing arrangement includes a length sensing arrangement and a weight sensing arrangement. The length sensing arrangement may be used to check or confirm the total length of the tubular, the effective length of the tubular, and/or the length of a threaded pin connector based on the tool joint location, for example. As used herein, the total length of the tubular is the length from one end of the tubular to the other. The effective length of the tubular is the length of the tubular without the threaded pin connector length. Accordingly, the summed length of the effective length and the threaded pin connector length is equal to the total length. The weight sensing arrangement may be used to check or confirm the weight of the tubular.

The sensing arrangement may be built-in or added on the structure described above and shown in FIG. 1 and, in at least some embodiments, may be configured to detect or sense an aspect of the tubular while on-the-fly. Therefore, the system may detect aspects of the tubular in the normal course of operation of introducing the tubular to the drilling rig 100, lifting the tubular, manipulating the tubular, or taking other action. As used herein, detecting measurements on the fly encompasses instances where the elements, such as the racker device 104, pauses for a moment of time to permit the detection to occur in a relatively static condition to improve accuracy. Detecting aspects on the fly also includes detecting or calculating measurements, such as the distance between ends of the tubular for example, in real time with the tubular in motion. This may be accomplished by, for example, calculating the distance between stop plates that may form a part of the racker device 104 even as the racker device 104 carries the tubular during a manipulation process.

The sensing arrangement may comprise one or more sensors that may be formed of a transducer, encoder, or other element, that is able to output a signal representative of an aspect of a tubular, such as a location, position, or measurable specification such as length or weight of a tubular or a part of the tubular.

Figure 2:
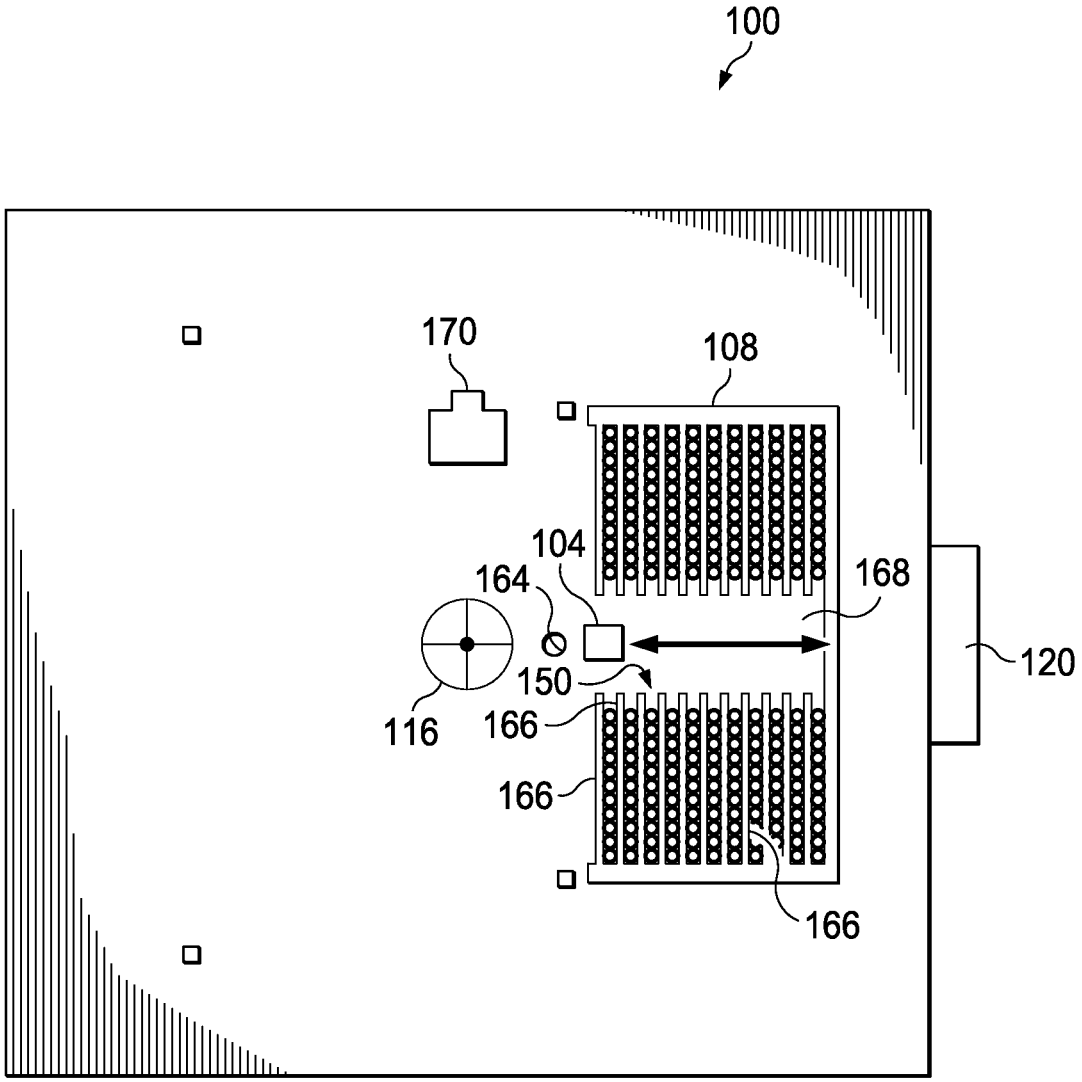
FIG. 2 is a schematic of top view of an exemplary drilling rig according to one or more aspects of the present disclosure.

FIG. 2 is a schematic of top view of the exemplary drilling rig 100 according to one or more aspects of the present disclosure. FIG. 2 illustrates the fingerboard 108, the stands 150, fingers 166 forming a part of the fingerboard 108, an iron roughneck 170, the mousehole 164, the well-center 116, and the racker device 104, all as generally described above. The iron roughneck 170 may be used to connect and disconnect pipe at either or both of the well-center 116 and the mousehole 164. A passageway 168 may extend between opposing sides of the fingerboard 108 between the v-door 120 and the well-center 116. The racker device 104 may travel along the passageway 168 indicated by the arrow in FIG. 2 to manipulate tubulars or stands between the fingerboard 108, the mousehole 164, the well-center 116, and the v-door 120.

Figure 3:
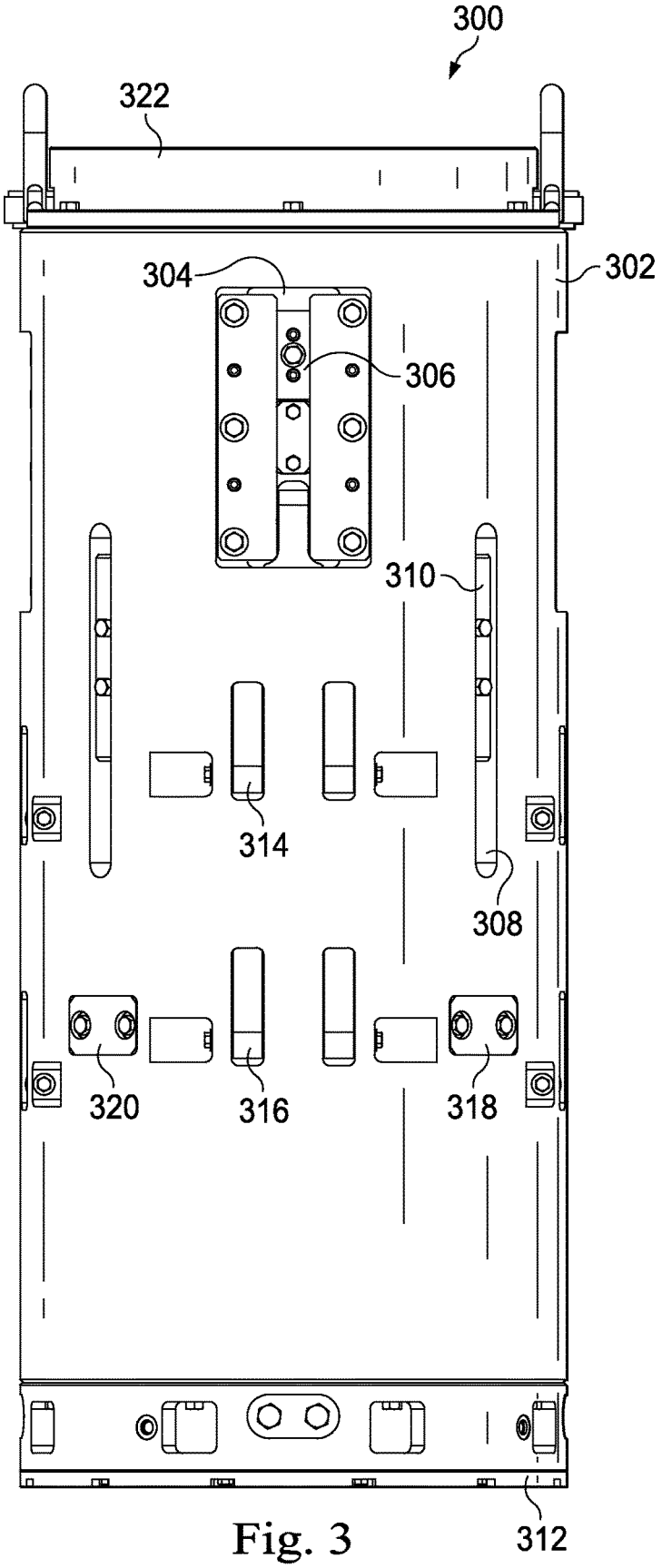
FIG. 3 is a schematic of a side view of an exemplary tubular retention system according to one or more aspects of the present disclosure.

FIG. 3 is a schematic of a side view of an exemplary tubular retention system 300 according to one or more aspects of the present disclosure.

As will be discussed in subsequent figures, the tubular retention system 300 retains tubulars, in part, by transferring the weight of the tubular(s) from one or more mutually opposing load bearing plate sets via upper and lower links (not shown in FIG. 3). In some embodiments, the tubular retentions system 300 includes two sets at opposing load bearing places, with the sets being disposed at a 90 degree angle offset to each other. Other sets may be offset at other angles. The tubular retention system 300 includes an external support structure 302 that surrounds an open center through which the tubulars enter and exit. In some embodiments, the tubular retentions system 300 is supported and disposed in a hole in the rig floor. As will be understood from the description below, the system opens to receive a tubular, and then closes to grasp or secure the tubular so it can be held stationary or rotated relative to another tubular so that the tubulars can be threaded together to make a stand.

The external support structure 302 includes slot 304. Slot 304 is an opening in the wall of the external support structure 302 that is sized and configured to receive a sliding anchor 306. Sliding anchor 306 is connected to an upper portion of a deflector plate (not shown in FIG. 3). As will be discussed in subsequent figures, each deflector plate may be attached to an upper section of a load bearing plate so that, when the corresponding load bearing plate moves, the deflector plate also moves. The sliding anchor 306 enables the attached deflector plate to slide up and down in response to movement from the corresponding load bearing plate that the deflector plate is connected with. In an embodiment, there are slots 304 and corresponding sliding anchors 306 disposed around the circumference of the exterior support surface, for example at locations that are vertically aligned with the location of each load bearing plate, such that there are as many slots 304 and sliding anchor 306 as there are load bearing plates on the interior of the tubular retention system 300.

The external support structure 302 also includes slot 308. Slot 308 is an opening in the wall of the external support structure 302 that is sized and configured to receive ring guide 310. Ring guide 310 is connected to a lifting ring (not shown in FIG. 3) in the interior of the tubular retention system 300 that will be discussed in subsequent figures. Ring guide 310 enables the lifting ring to slide up and down to coordinate the movement of each load bearing plate.

The tubular retention system 300 also includes a base 312 which is attached to the external support structure 302. As shown in FIG. 3, the tubular retention system 300 also includes pins 314 and 316, which are used to attach the upper and lower links (described below), respectively, that transfer the weight of a tubular(s) from respective load bearing plates to the external support structure 302. Supports 318 and 320 provide an opposing surface for respective biasing elements that are set between the supports 318 and 320 and the lifting ring, used to provide an upward-biasing force. As will be discussed with respect to subsequent figures, this upward-biasing force causes the mutually opposing load bearing plate sets to naturally be in an "open" position, or a position where tubulars of varying diameters may be inserted into the open center of the tubular retention system 300 for subsequent retention. In an embodiment, the supports 318 and 320 are offset by 45 degrees from each load bearing plate, and therefore at 90 degree offsets from each other (e.g., meaning that there are two supports not shown in FIG. 3 that are located at the opposite side of the external support structure 302).

The tubular retention system 300 may also include bowl 322. The bowl 322 may be attached to a top section of the external support structure 302. The bowl 322 also includes an open center that allows tubulars of varying diameters to pass. In an embodiment, the bowl 322 is sized and shaped to allow conventional slips to be manually placed within it so to retain a tubular should any mechanical system of embodiments of the present disclosure, for example the load bearing plates, fail. In this manner, in embodiments of the present disclosure the tubular retention system 300 may still operate in a conventional manner should any catastrophic failure occur with any power, hydraulic, or mechanical subsystem. Alternatively, slips placed within the bowl 322 may be used in cooperation with the mutually opposing links in embodiments of the present disclosure.

Figure 4A:
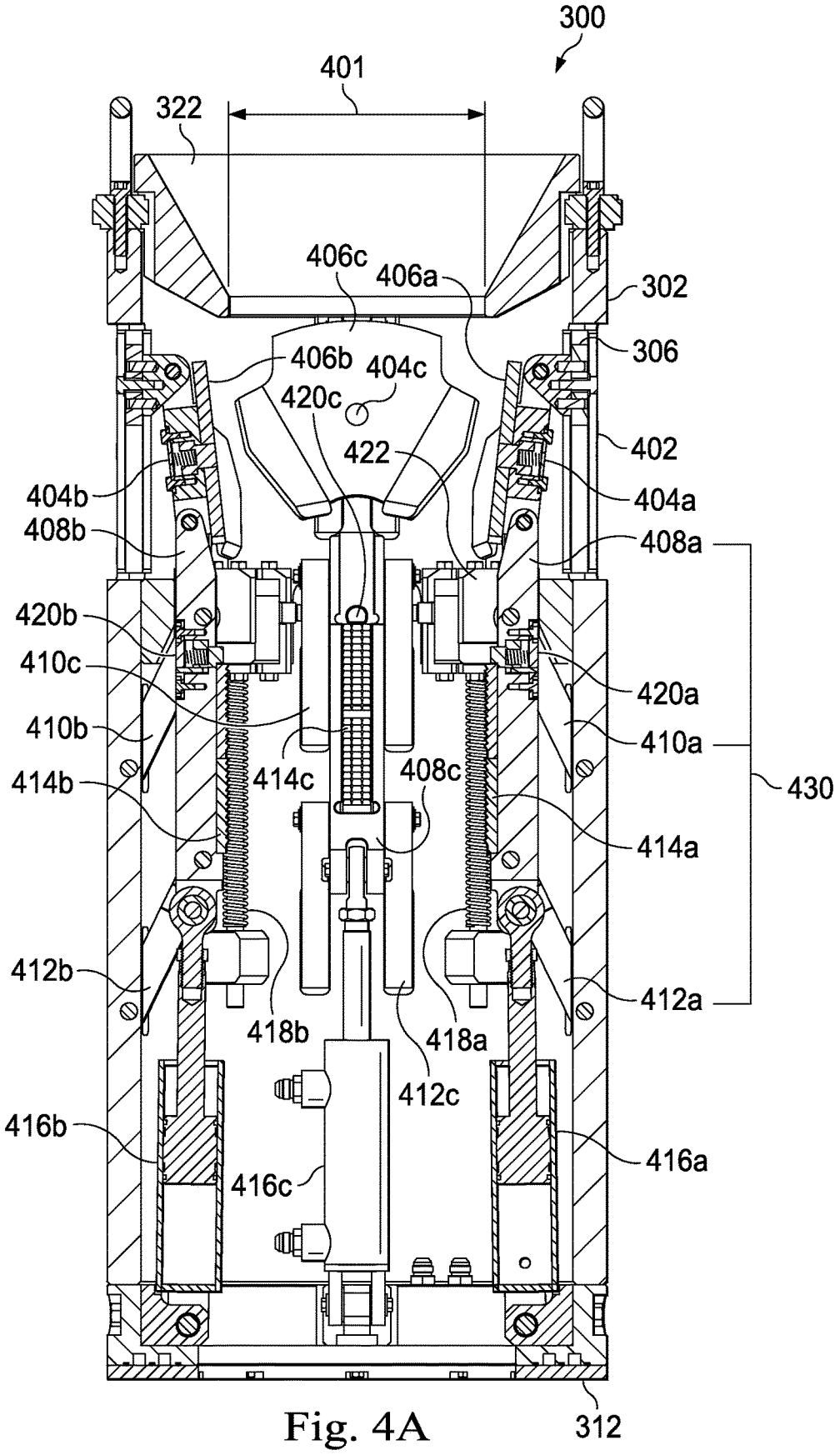
FIG. 4A is a schematic of a cross-sectional side view of an exemplary tubular retention system according to one or more aspects of the present disclosure.
Figure 4B:
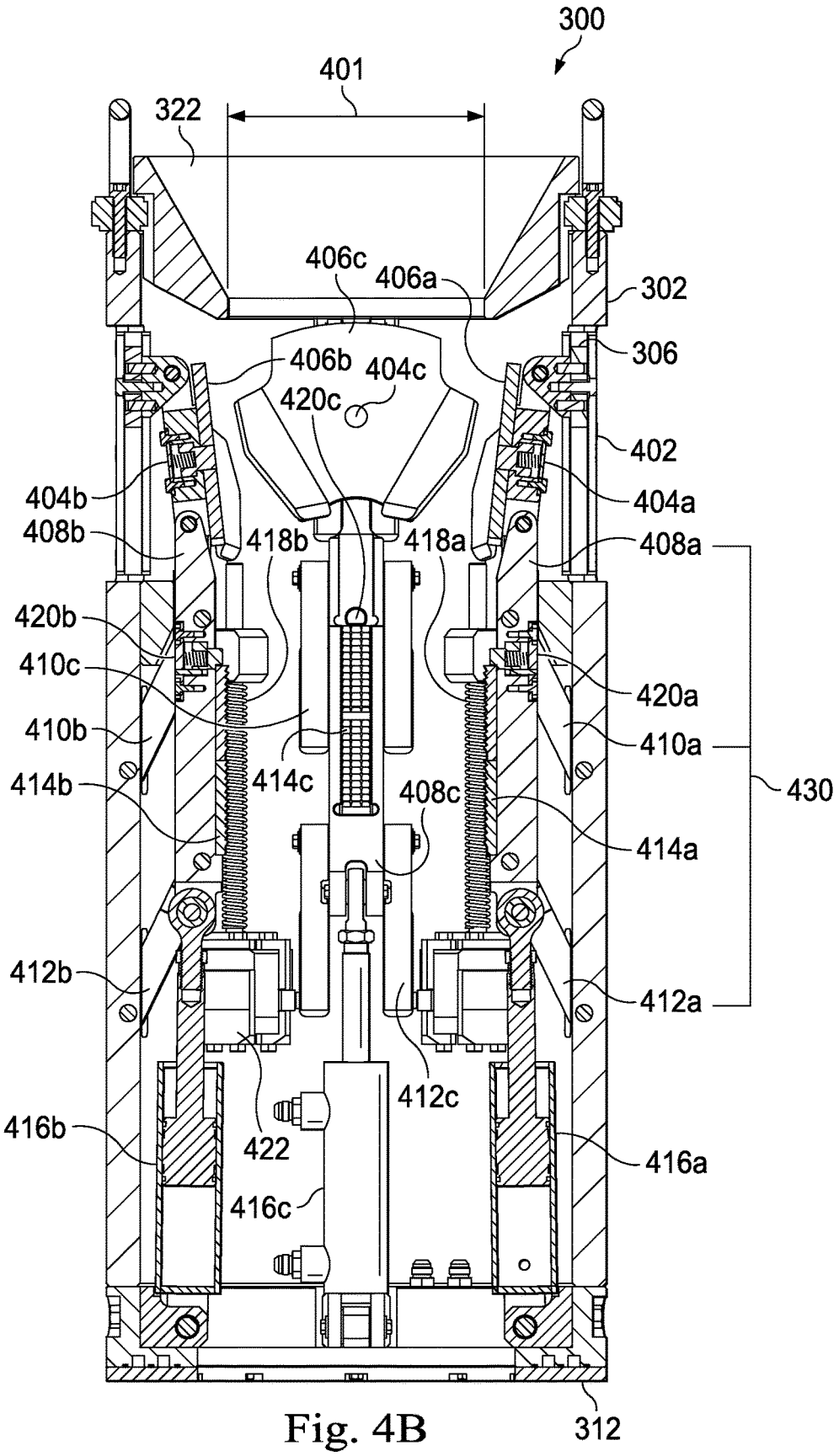
FIG. 4B is a schematic of a cross-sectional side view of an exemplary tubular retention system according to one or more aspects of the present disclosure.
Figure 5:
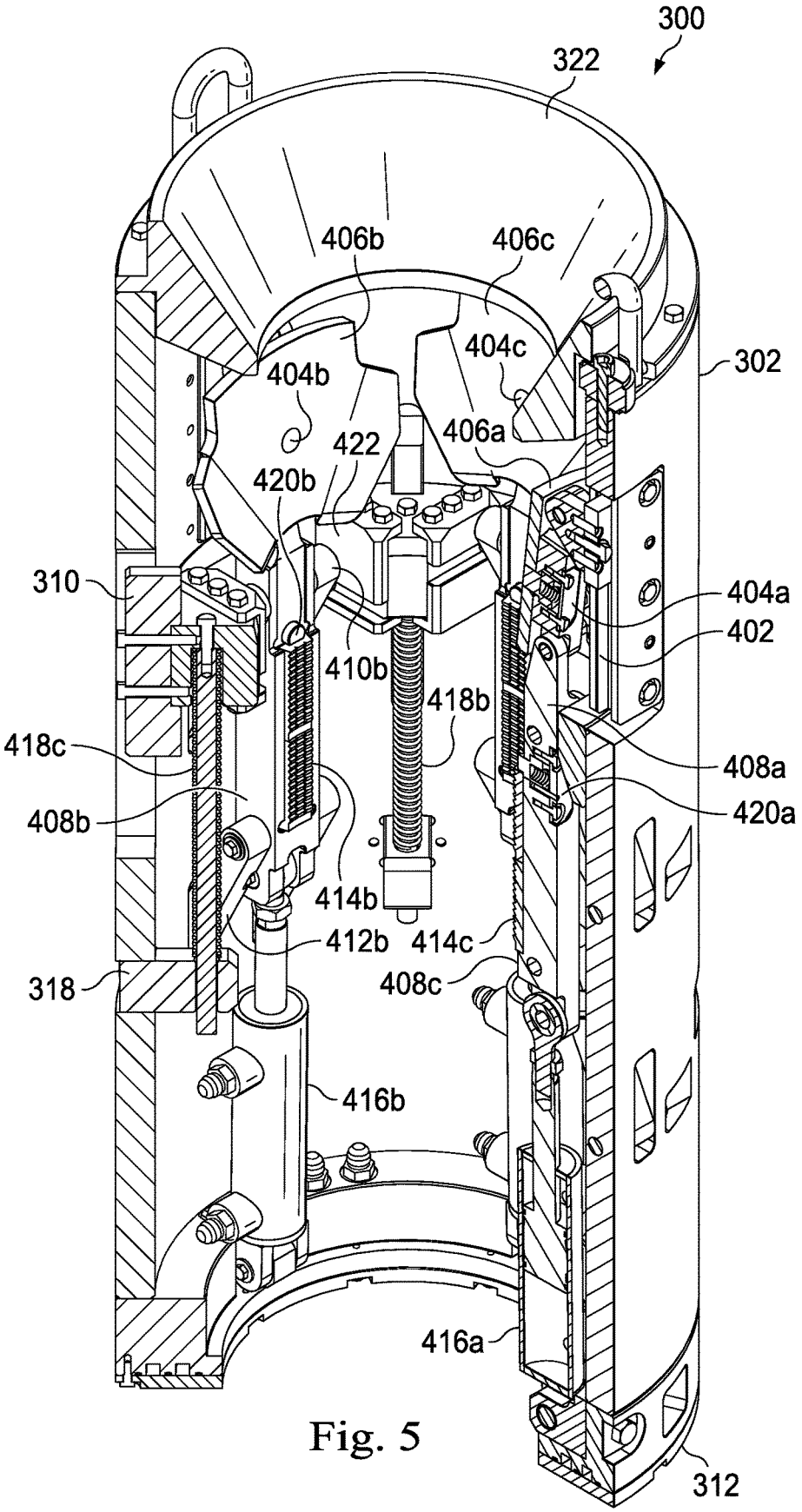
FIG. 5 is a schematic of a perspective cross-sectional view of an exemplary tubular retention system according to one or more aspects of the present disclosure.

FIGS. 4 and 5, respectively, are a schematic of a side view and a schematic of a perspective cross-sectional view of the exemplary tubular retention system 300 according to one or more aspects of the present disclosure. In an embodiment, FIG. 4A illustrates a vertical cross-section of the tubular retention system 300 of FIG. 3. Tubulars are inserted and removed through the open center 401, which runs the vertical length of the tubular retention system 300 as shown in FIG. 4A.

Sliding anchor 306 is connected to an upper portion of a deflector plate, for example deflector plate 406*a* in FIGS. 4 and 5. The sliding anchor 306 may move up and down along track 402. FIGS. 4 and 5 illustrate an embodiment in which four deflector plates 406 are present (only 406*a*-406*c* are shown in FIGS. 4 and 5), although more or fewer deflector plates may be used. Deflector plate 406*a* is connected between the sliding anchor 306 and an upper section of a load bearing plate 408*a*. In an embodiment, the deflector plate 406*a* is removably coupled to the system, held in place by deflector pin 404*a* for example on a dovetail fixing channel, as shown in more detail below with respect to FIG. 7C. The deflector pin 404*a* may be spring loaded to enable quick removal of the deflector plate 406*a* and replacement with a new deflector plate 406*a* should such become necessary or desired.

As used herein, components similar in function and/or structure may be referred to by a common reference numeral generally, such as deflector plates 406, while specific components may be specifically identified by reference ending with a suffix, such as deflector plate 406*a*.

In an exemplary embodiment, the deflector plate 406*a* is connected to a top portion of a gripping system 430 formed of the load bearing plate 408*a*, an upper link 410*a* and a lower link 412*a*. Ends of the upper link 410*a* and the lower link 412*a* are, in this embodiment, connected via the external support structure 302. Accordingly, the gripping system 430 forms a four-bar mechanism. The load bearing plate 408*a* is a structure that is parallel to the long axis of the tubular retention system 300 that runs the length of the open center 401. The load bearing plate 408*a* includes die 414*a*, which constitutes the surface that comes in contact with a tubular that has been inserted into the open center 401. In an embodiment, the die 414*a* includes teeth or other material that may "bite" into or frictionally engage the tubular to result in a strong grip and reduce risk of slip. Although shown in FIGS. 4 and 5 as a single long strip of material, those skilled in the relevant art(s) will recognize that the single strip forming the die 414*a* could instead be any number of smaller sections that, together, are in contact with and grip the surface of a tubular. In an embodiment, the die 414*a* is removably coupled to the system 300, held in place by die pin 420*a* for example on a dovetail fixing channel, as shown in more detail below with respect to FIG. 8C. The die pin 420*a* may be spring loaded to enable quick removal of the die 414*a* and replacement with a new die 414*a* as necessary or desired.

The load bearing plate 408*a* may be connected to the external support structure 302 via an upper link 410*a* and a lower link 412*a*. These links 410*a* and 412*a* may have the same length and are parallel to each other so that, when viewed in cross-section, the load bearing plate 408*a*, upper link 410*a*, lower link 412*a*, and external support structure 302 form a parallelogram shape that is used in cooperation to support the weight of a tubular inserted into the open center 401. In an embodiment, there is one upper link 410*a* and one lower link 412*a* attached between the load bearing plate 408*a* and the external support structure 302. Alternatively, there may be two upper links 410*a* and two lower links 412*a* attached on each side of the load bearing plate 408*a*.

An actuator 416*a* may connect between a bottom section of the load bearing plate 408*a* and the base 312 of the tubular retention system 300. The actuator 416*a* may be a hydraulic cylinder, an engine, a driver, or other actuator capable of exerting sufficient force to induce movement in the load bearing plate 408*a*. In an embodiment, the actuator 416*a* is a hydraulic cylinder, such as a double acting cylinder where fluid pressure is applied in both directions to a piston located inside the cylinder. Although shown in FIGS. 4 and 5 as having as many actuators 416 as load bearing plates 408, it will be recognized that more or fewer actuators 416 may be included as long as they are capable of overcoming an upward-biasing force discussed below.

The tubular retention system 300 includes similar assemblies for corresponding load bearing plates 408*b* and 408*c* as shown in FIGS. 4 and 5, which illustrate an exemplary embodiment that utilizes two sets of mutually opposing load bearing plates, or four individual load bearing plates, of which only load bearing plates 408*a*-408*c* are shown. The load bearing plate 408*b* may be connected to deflector plate 406*b*, upper link 410*b*, lower link 412*b*, and actuator 416*b*, with accompanying features such as deflector pin 404*b* and die pin 420*b*, as discussed above with respect to the load bearing plate 408*a*. Similarly, the load bearing plate 408*c* may be connected to deflector plate 406*c*, upper link 410*c*, lower link 412*c*, and actuator 416*c*, with accompanying features such as deflector pin 404*c* and die pin 420*c*, as discussed above with respect to the load bearing plate 408*a*.

In the exemplary embodiment shown, the gripping systems 430 are operatively coupled together via a lifting ring 422. In the exemplary embodiment shown here, the lifting ring 422 is connected to each of the load bearing plates 408 of the gripping systems 430 separately. In some examples, the lifting ring 422 is coupled to a portion of the upper links 410 or the lower links 412. In the exemplary embodiment shown, the lifting ring 422 connects with sides of the external support structure 302 via biasing element 418. The biasing element 418 may be, for example, a spring. The cross-sectional view of FIG. 4A shows only biasing elements 418*a* and 418*b*. Some embodiments, such as FIGS. 4 and 5, include a total of 4 biasing elements 418, each associated with one of the gripping systems 430, and, for example, offset by 45 degrees from each load bearing plate (in FIG. 4A, biasing element 418*a* is shown as 45 degrees offset between load bearing plates 408*a* and 408*c*, for example), and therefore at 90 degree offsets from each other along an inner circumference of the external support structure 302. Biasing elements 418 may be connected to the external support structure 302 by supports, such as, for example, supports 318 and 320 (FIG. 3), and others spaced about the interior of the support structure. The biasing elements 418 provide an upward-biasing force to the lifting ring 422, thereby biasing each of the load bearing plates 408*a*-408*d* to an "open" position away from the open center 401, where a tubular may be fed into the tubular retention system 300.

In operation, a biasing system may exert a downward force sufficient to overcome the upward-biasing force of the biasing elements 418*a*-418*d*. In this example, the biasing system includes the actuators 416*a*-416*d*. In response to this downward force, the load bearing plates 408 move downward and radially inward toward the central longitudinal axis of the tubular retentions system along the open center 401. This downward and radially inward movement may continue until the dies 414*a*-414*d* engage a tubular of a given diameter inserted into the open center 401. Since the upper links 410*a*-410*d* have the same length as the lower links 412*a*-412*d*, the system operates as a four-bar mechanism and the parallelogram shape generally is maintained, causing the load bearing plates 408*a*-408*d* to remain in a substantially vertical orientation along their lengths in parallel with the long axis of the tubular retention system 300 that runs the length of the open center 401. The movement of the load bearing plates 408*a*-408*d* may be synchronized by the lifting ring 422.

Figure 6A:
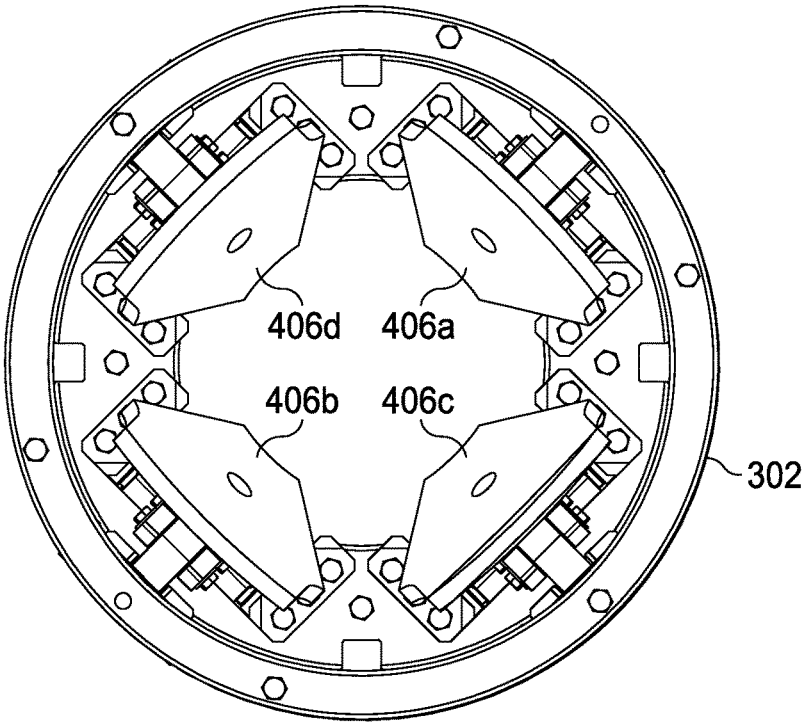
FIG. 6A is a schematic of a top view of an exemplary tubular retention system in an open position according to one or more aspects of the present disclosure.
Figure 6B:
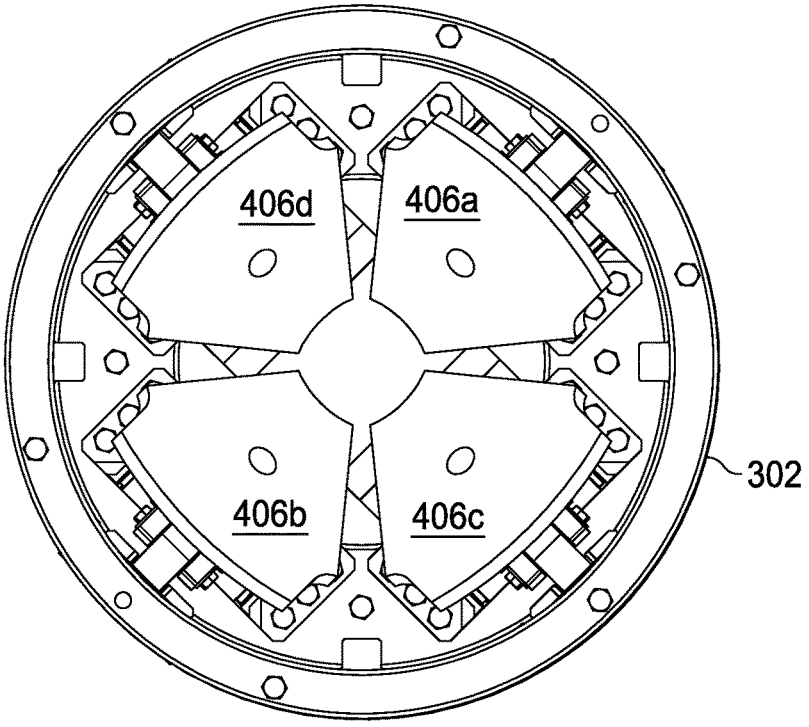
FIG. 6B is a schematic of a top view of an exemplary tubular retention system in a closed position according to one or more aspects of the present disclosure.

As the actuators 416*a*-416*d* force the load bearing plates 408*a*-408*d* to move downward and radially inward, the movement of the load bearing plates 408*a*-408*d* causes the bottom portions of deflector plates 406 to move downward and radially inward as well. As the bottom portions of the deflector plates 406 move downward and radially inward, the top portions of the deflector plates 406 connected to the sliding anchors 306 (FIG. 3) slide along the track 402 (one provided for each deflector plate 406 though not labeled expressly as such in FIG. 4A) to allow each of the deflector plates 406 to decrease the operative size of the open center 401, as shown in FIG. 6B discussed in more detail below. As the deflector plates 406*a*-406*d* move downward and inward in response to the movement of the load bearing plates 408*a*-408*d*, the bottom surfaces of the deflector plates 406*a*-406*d* provide a centering force to the tubular inserted into the open center 401 until the dies 414*a*-414*d* engage the tubular. In addition, the deflector plates 406 may provide some protection to other components of the gripping system 430.

In some embodiments, the links 410, 412 are positioned and have a length that enables the links to be angled upwardly from the external support structure 302 while they are engaged with the tubular. This arrangement allows the load bearing plates 408 to frictionally engage the tubular, and the weight of the tubular acts to increase the gripping force on the tubular. Accordingly, in some embodiments, the links 410, 412 are sized and positioned to form an angle between 89 degrees and 45 degrees relative to the longitudinal axis of the tubular retention system 300. In some embodiments, the angle is between 85 and 60 degrees relative to the longitudinal axis of the tubular retention system 300. Therefore, in some embodiments, the mere weight of the tubular may be sufficient to frictionally lock the tubular in place.

Once the tubular has been engaged by the dies 414*a*-414*d*, in an embodiment where the actuators 416*a*-416*d* are hydraulic cylinders, the hydraulic system may be locked to prevent releasing or slippage. This occurs, for example, where a second tubular is being threadably coupled or decoupled from the tubular currently engaged and held by the dies 414*a*-414*d* via the combined force of the locked hydraulic system and the weight of the tubular(s) as transferred via the upper and lower links 410*a*-410*d* and 412*a*-412*d* to the external support structure 302. Even while engaged with the tubular, the load bearing plates 408*a*-408*d* maintain a substantially parallel vertical alignment with the length of the tubular as a result of the parallelogram structure of the links and plates with respect to the external support structure 302. The total amount of force as measured in pounds that is applied to the tubular will vary depending on the diameter of the tubular, but in embodiments of the present disclosure, does not exceed a force above and beyond what the tubular can withstand before being crushed, for example well below 5 tons of force. As a result, the dies 414*a*-414*b* do not have to be as large or fully encircle the tubular, as may be done with conventional slips utilized at the well-center 116.

When the tubular is ready to be released (e.g., after another tubular has been coupled or decoupled), in an embodiment where the actuators 416*a*-416*d* are hydraulic cylinders, the hydraulic system may set the hydraulic circuit to return to tank. The weight of the tubular connected to the dies, because of frictional force, provides sufficient downward force still to hold the tubular in place against the dies 414*a*-414*d*. When the tubular is to be released, it may be lifted or raised from the mousehole. For example, the racker device 104 (FIG. 1) applies an external upward force that upwardly displaces the tubular. In some embodiments, this is sufficient to cause the dies 414*a*-414*d* to disengage from the tubular and thereby release it. In cooperation with this force and movement, the upward-biasing force provided by the biasing elements 418*a*-418*d* force the lifting ring 422 upward, which causes the load bearing plates 408*a*-408*d* to lift upward and radially outward to further release the tubular and resume an "open" position in preparation for receiving another tubular. This upward and outward movement of the load bearing plates 408*a*-408*d* also causes the deflector plates 406*a*-406*d* to return to an "open" position as shown in FIG. 6A. The upward motion of the load bearing plates 408*a*-408*d* may again be synchronized by the lifting ring 422, resulting in a uniform return to the "open" position.

In the above discussion, the biasing elements 418*a*-418*d* have been described and shown to provide an upward-biasing force to the load bearing plates 408 to bias them upward and radially outward in the "open" position. In an alternative embodiment illustrated in FIG. 4B, a biasing system imparts a force to move the load bearing plates 408*a*-408*d* downward and radially inward. In FIG. 4B, the biasing elements 418*a*-418*d* may constitute the biasing system and may be placed within the tubular retention system 300 in a location that biases the load bearing plates 408 downward and radially inward in the "closed" position. For example, in this alternative embodiment the supports 318 and 320 (of FIG. 3) may be placed in locations between the slot 304 and the slots for the pin 314. The movement of the load bearing plates 408*a*-408*d* may be synchronized by the lifting ring 422. As a result, the biasing elements 418*a*-418*d* may be connected to the external support structure 302 above the lifting ring 422, between the supports 318 and 320 and the lifting ring 422. In this configuration, the biasing elements 418*a*-418*d* provide a downward-biasing force to the lifting ring 422, thereby biasing each of the load bearing plates 408*a*-408*d* to a "closed" position toward the center 401. In this alternative embodiment, the actuators 416*a*-416*d* may be attached to the load bearing plates 408 as generally discussed above.

In operation according to this alternative embodiment, the actuators 416*a*-416*d* may exert an upward force sufficient to overcome the downward-biasing force of the biasing elements 418*a*-418*d*. In response to this upward force, the load bearing plates 408 move upward and radially outward away from the central longitudinal axis of the tubular retentions system along the open center 401. This upward and radially outward movement may continue until the dies 414*a*-414*d* disengage a tubular of a given diameter and the tubular may be removed. During this movement, the load bearing plates 408*a*-408*d* remain in a substantially vertical orientation along their lengths in parallel with the long axis of the tubular retention system 300 that runs the length of the open center 401. In an embodiment, the upward force provided by the actuators 416*a*-416*d* may be approximately equal to the weight of the gripping systems 430 that is sufficient to counter-act the downward-biasing force of the biasing elements 418*a*-418*d*. As a result, when the actuators 416*a*-416*d* are engaged to move open the gripping systems 430, the force is insufficient on its own. Instead, an additional upward force provided by the racker device 104 (FIG. 1) upwardly displaces the tubular in cooperation with the upward force of the actuators 416*a*-416*d*.

When the tubular is ready to be engaged (e.g., after another tubular has been coupled or decoupled), in an embodiment where the actuators 416*a*-416*d* are hydraulic cylinders, the hydraulic system may set the hydraulic circuit to return to tank after the tubular has been inserted into the open center 401 made larger by the upward/radially outward movement of the load bearing arms 408. With the tubular positioned in the open center and the actuators 416*a*-416*d* disengaged, the downward-biasing force provided by the biasing elements 418*a*-418*d* force the lifting ring 422 downward, which causes the load bearing plates 408*a*-408*d* to move downward and radially inward until the dies 414*a*-414*d* engage the tubular. As the biasing elements 418*a*-418*d* force the load bearing plates 408*a*-408*d* to move downward and radially inward, the movement of the load bearing plates 408*a*-408*d* causes the bottom portions of deflector plates 406 to move downward and radially inward as well and operate as described above with respect to the other embodiment. The downward/inward movement continues until the load bearing plates 408 frictionally engage the tubular, and the weight of the tubular acts to increase the gripping force on the tubular. Once the tubular has been engaged by the dies 414*a*-414*d*, in an embodiment where the actuators 416*a*-416*d* are hydraulic cylinders, the hydraulic system may be locked to prevent releasing or slippage.

FIGS. 6A and 6B are schematics of a top view of the exemplary tubular retention system 300 in an "open" position and a "closed" position, respectively, according to one or more aspects of the present disclosure. In FIG. 6A, the load bearing plates 408*a*-408*d* are in an "open" position in preparation for receiving a tubular. The position of the load bearing plates 408 causes the deflector plates 406 to be lowered, enlarging the diameter of the open center 401.

In FIG. 6B, the deflector plates 406*a*-406*d* are in a "closed" position in response to the load bearing plates 408*a*-408*d* being pulled downward and radially inward in response to a downward force applied by the actuators 416*a*-416*d* (FIGS. 4 and 5). As shown in FIG. 6B, each deflector plate 406*a*-406*d* may include an arcuate shape at their lower or inner ends, which provides a surface that closely follows the circumference of a tubular as the deflector plates 406*a*-406*d* center the tubular in the open center 401 as the diameter of the open center 401 decreases.

Figure 6C:
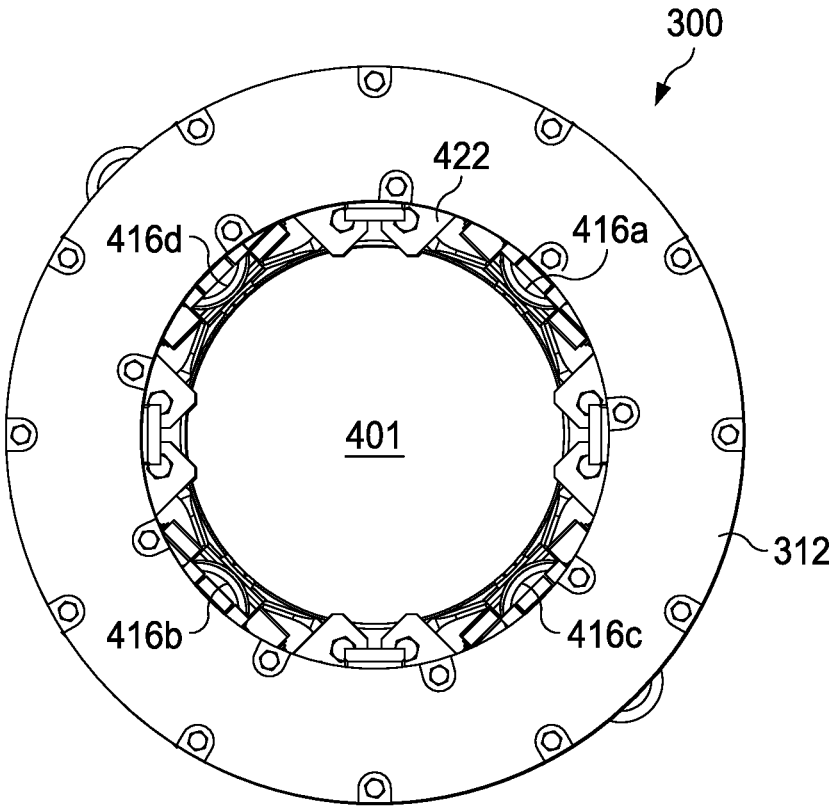
FIG. 6C is a schematic of a bottom view of an exemplary tubular retention system according to one or more aspects of the present disclosure.

FIG. 6C is a schematic of a bottom view of the exemplary tubular retention system 300 according to one or more aspects of the present disclosure. As shown in FIG. 6C, the base 312 is an annulus with the open center 401 as well, so that a tubular inserted into the top end of the tubular retention system 300 may also extend through the base 312, for example where a stand is being assembled with two or more individual tubulars that extend into a mousehole. An outer, bottom edge of each of the actuators 416*a*-416*d* are also visible in FIG. 6C. Although depicted in FIGS. 4, 5, and 6A-6C as being at the base 312 of the tubular retention system 300, it will be understood that the actuators 416*a*-416*d* may be located elsewhere in the tubular retention system. In some embodiments, they are closer to the load bearing plates 408*a*-408*d*.

Figure 7A:
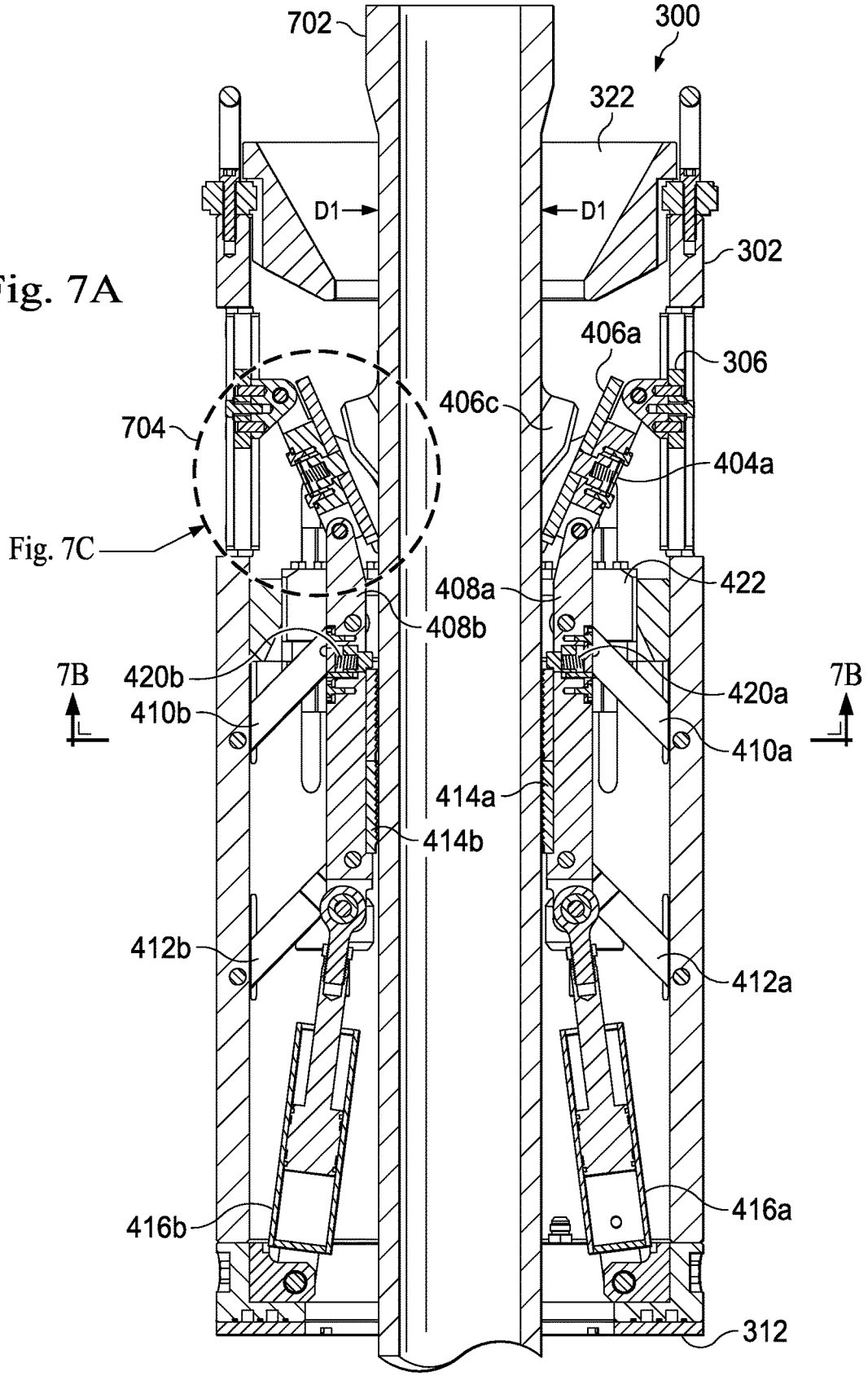
FIG. 7A is a schematic of a cross-sectional side view of an exemplary tubular retention system in operation according to one or more aspects of the present disclosure.

FIG. 7A is a schematic of a side view of the exemplary tubular retention system 300 in operation according to one or more aspects of the present disclosure. Specifically, FIG. 7A illustrates the retention of a tubular 702 that has a first diameter $D_1$ that is relatively large with respect to the diameter of the open center 401. In order to engage the sides of the tubular 702, the actuators 416 exert a downward force to pull the respective load bearing plates 408 down until the dies 414*a*-414*d* come in contact with the tubular 702. The actuators 416*a*-416*d* may then be locked which, together with the downward force provided by the weight of the tubular 702 itself transferred via the upper links 410*a*-410*d* and lower links 412*a*-412*d* to the external support structure 302, holds the tubular 702 in place while the tubular is worked on (e.g., by threadably coupling or decoupling other tubulars). Detailed view 704 will be discussed below with respect to FIG. 7C.

Figure 7B:
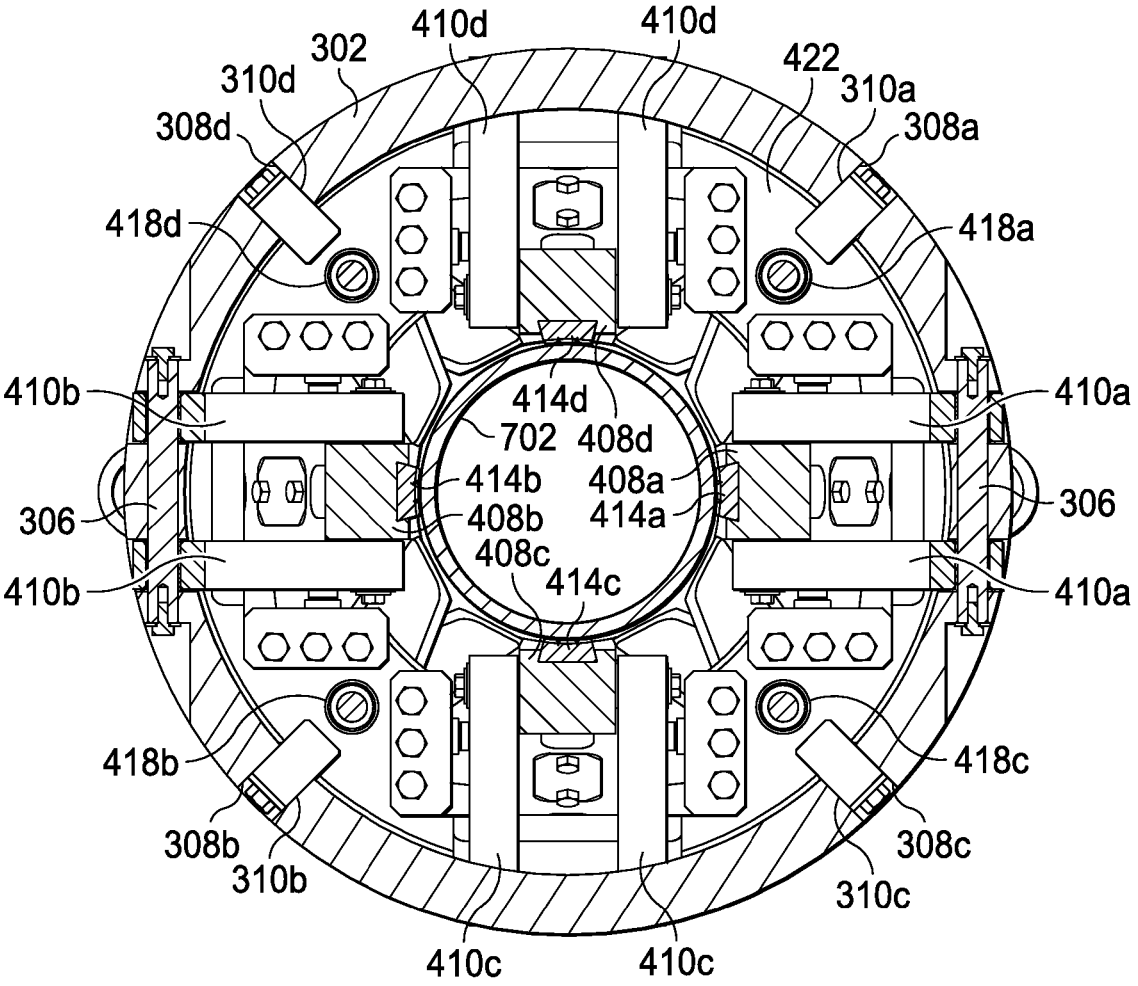
FIG. 7B is a schematic of a transverse cross-sectional view of an exemplary tubular retention system in operation according to one or more aspects of the present disclosure.

FIG. 7B is a schematic of a top cross-sectional view of the exemplary tubular retention system 300 in operation according to one or more aspects of the present disclosure. Specifically, FIG. 7B is a cross-sectional view of the tubular retention system 300 along lines 7B-7B, while the tubular 702 with diameter $D_1$ is engaged by the dies 414*a*-414*d*. In addition to the elements already discussed above with respect to FIGS. 3-5, 6A-6C, and 7A, FIG. 7B further shows ring guides 310*a*-310*d*. Ring guides 310*a*-310*d* are movably connected in the slots 308, described above with respect to FIG. 3 as openings in the wall of the external support structure 302. The ring guides 310*a*-310*d* assist in guiding the motion of the lifting ring 422 as the load bearing plates 408*a*-408*d* move up or down, based on the total force exerted. The lifting ring 422 synchronizes movement of the gripping systems 430 operatively coupled together.

Figure 7C:
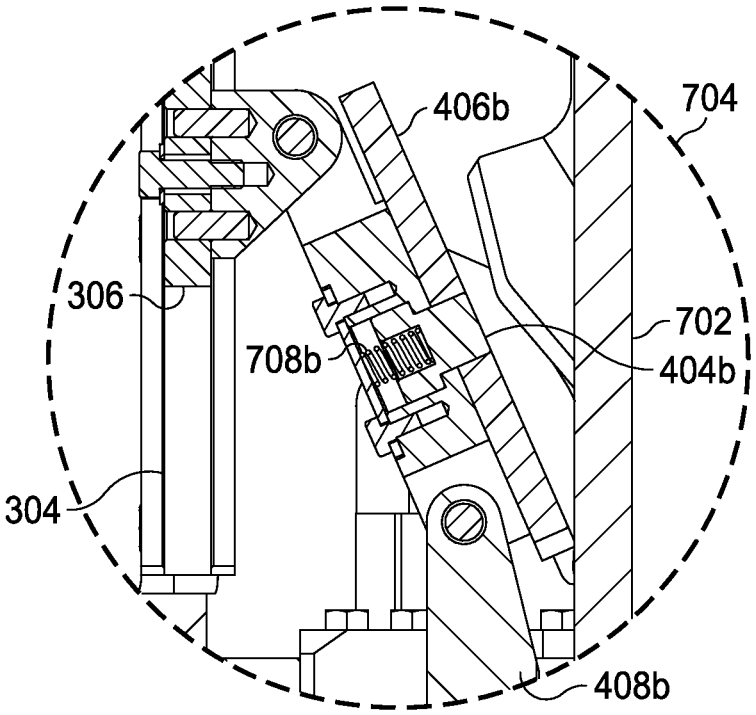
FIG. 7C is a schematic of a portion of the exemplary tubular retention system shown in FIG. 7A according to one or more aspects of the present disclosure.

FIG. 7C is the detailed view 704 from FIG. 7A, showing a portion of the exemplary tubular retention system 300 in operation according to one or more aspects of the present disclosure. Specifically, FIG. 7C shows a detailed view of the region that contains the deflector plate 406*b* from FIG. 7A. In embodiments discussed herein, the deflector plate 406*b* is removably coupled to the system and held in place by deflector pin 404*b*. The deflector pin 404*b* may be spring loaded by deflector spring 708*b* to enable quick removal of the deflector plate 406*b* and replacement with a new deflector plate 406*b* should such become necessary or desired, for example by pressing down on the deflector pin 404*b* with sufficient force to overcome the upward force of the deflector spring 708*b*. Although discussed with respect to deflector plate 406*b* specifically, corresponding details exist with respect to the other deflector plates 406*a*, 406*c*, and 406*d* according to the exemplary embodiments of FIGS. 4 and 5.

Figure 8A:
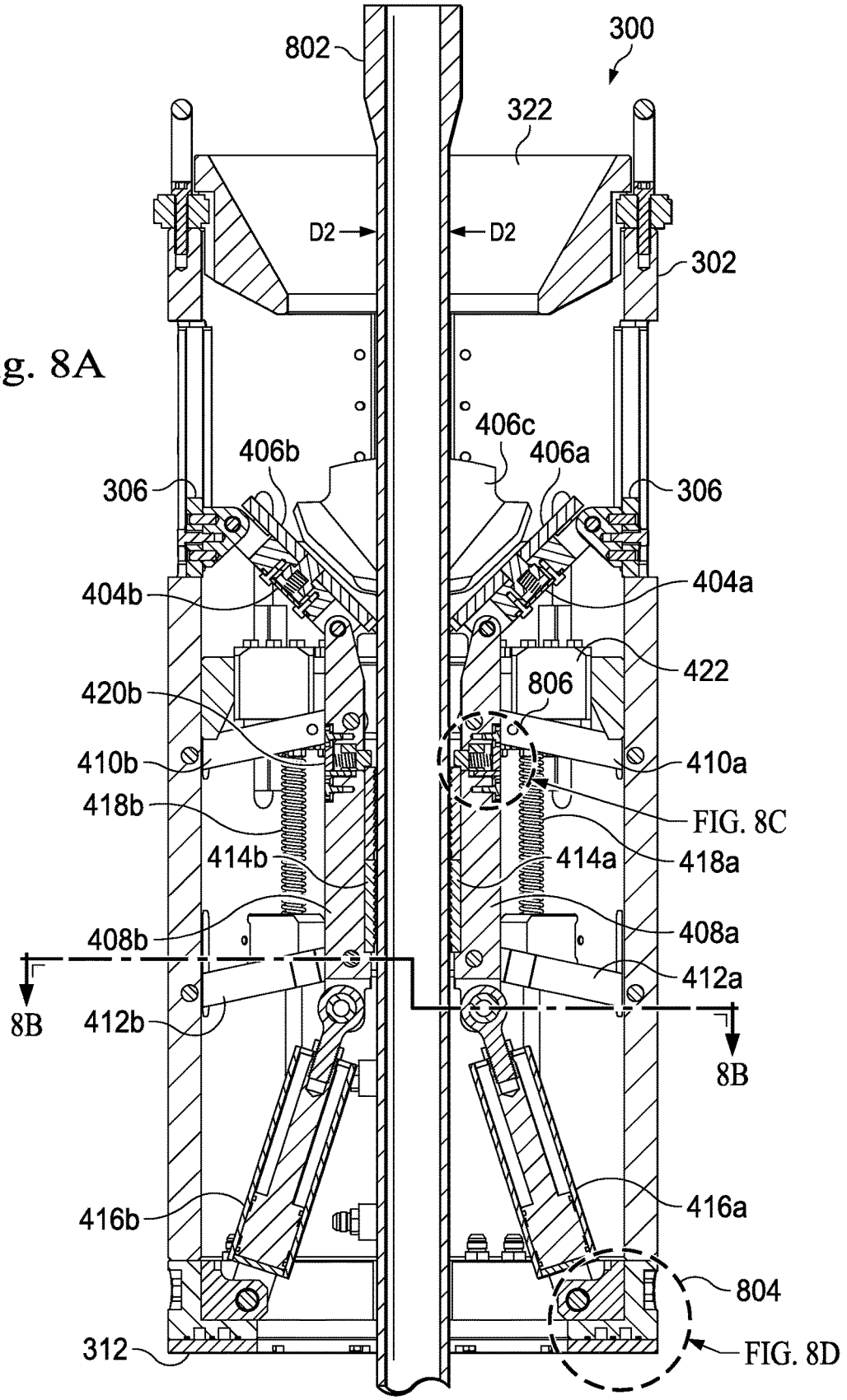
FIG. 8A is a cross-sectional schematic of a side view of an exemplary tubular retention system in operation according to one or more aspects of the present disclosure.

FIG. 8A is a schematic of a side view of the exemplary tubular retention system 300 in operation according to one or more aspects of the present disclosure. Specifically, FIG. 8A illustrates the retention of a tubular 802 that has a second diameter $D_2$ that is relatively smaller than D1 in FIG. 7A with respect to the diameter of the open center 401, where for example $D_2<D_1$. As will be recognized, the diameters of the tubulars 702 and 802 of FIGS. 7A and 8A are exemplary only to demonstrate operation of the tubular retention system 300, and the present disclosure is not limited to only operating on tubulars of these two diameters. The tubular retention system 300 may receive tubulars having an entire range of tubulars, for example ranging from less than 2 inches to larger than 18 inches (diameter) by way of non-limiting example. In another example, the size may range from less than 2 inches to larger than 10 inches (diameter) by way of nonlimiting example. Other sizes, larger and smaller, are also contemplated.

In order to engage the sides of the tubular 802, the actuators 416*a*-416*d* exert a downward force to pull the load bearing plates 408*a*-408*d*, which are mutually opposing as shown, down until the dies 414*a*-414*d* come in contact with the tubular 802. The actuators 416*a*-416*d* may then be locked which, together with the downward force provided by the weight of the tubular 802 itself transferred via the upper links 410*a*-410*d* and lower links 412*a*-412*d* to the external support structure 302, holds the tubular 802 in place while the tubular is worked on (e.g., by threadably coupling or decoupling other tubulars). Detailed view 804 will be discussed below with respect to FIG. 8C, and detailed view 806 with respect to FIG. 8D.

Figure 8B:
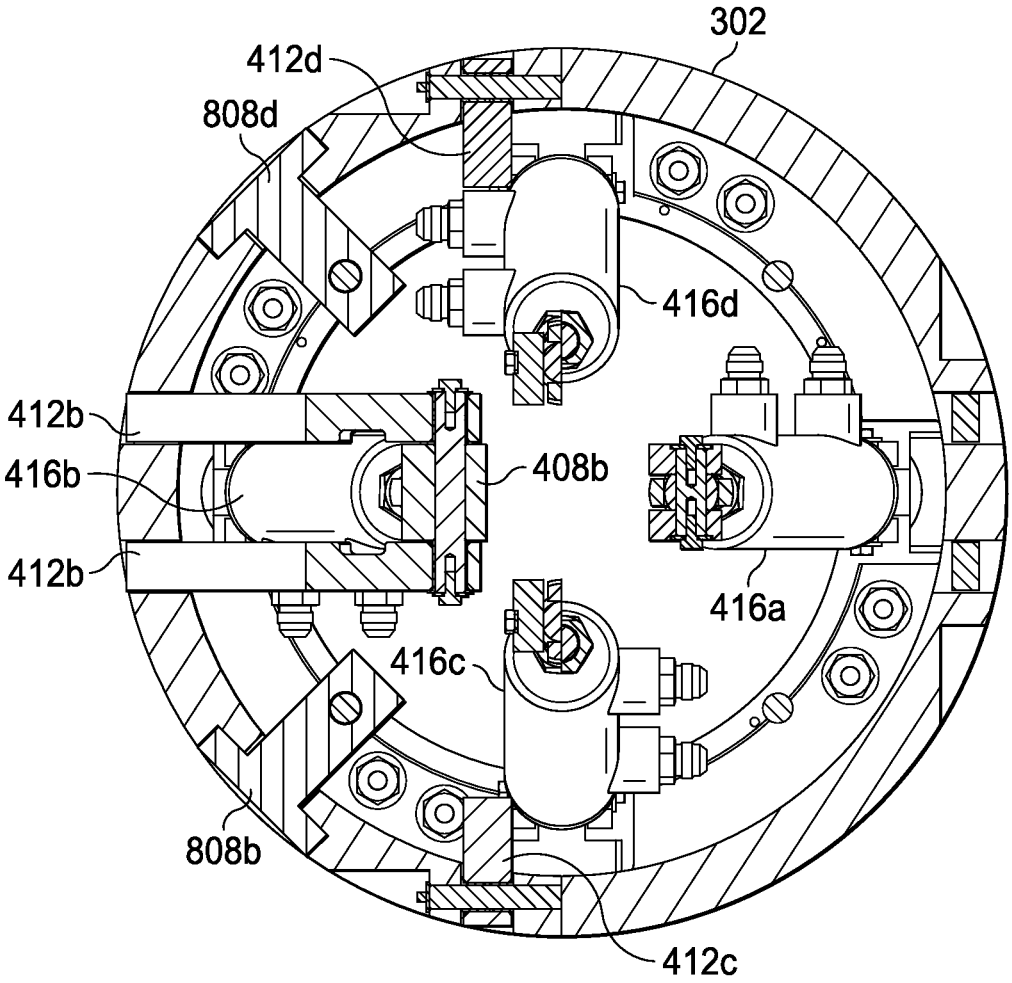
FIG. 8B is a schematic of a transverse cross-sectional view of an exemplary tubular retention system in operation according to one or more aspects of the present disclosure.

FIG. 8B is a schematic of a top cross-sectional view of the exemplary tubular retention system 300 in operation according to one or more aspects of the present disclosure taken along lines 8B-8B in FIG. 8A. Specifically, FIG. 8B is a cross-sectional view of the tubular retention system 300 while the tubular 802 with diameter $D_2$ is engaged by the dies 414. In addition to the elements already discussed above with respect to FIGS. 3-8A, FIG. 8B further shows supports 808 (only 808*b* and 808*d* shown in FIG. 8B due to nature of cross-section). Supports 808 are examples of supports 318 and 320 introduced in FIG. 3 above. The shown supports 808 are the base to which the biasing elements 418 are attached, and provide the base against which the biasing elements 418 press to provide the upward-biasing force.

Figure 8C:
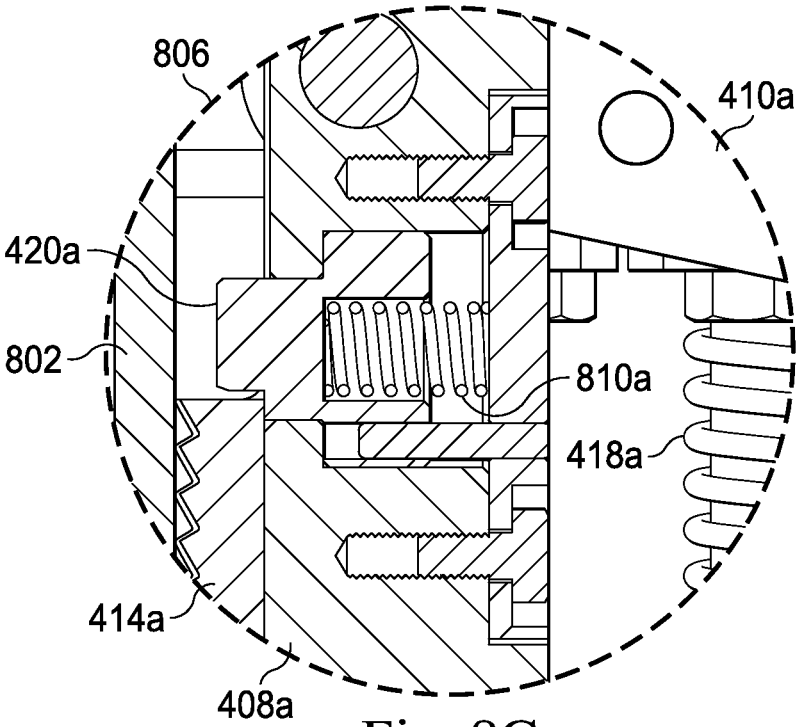
FIG. 8C is a schematic of a portion of an exemplary tubular retention system in operation according to one or more aspects of the present disclosure.
Figure 8D:
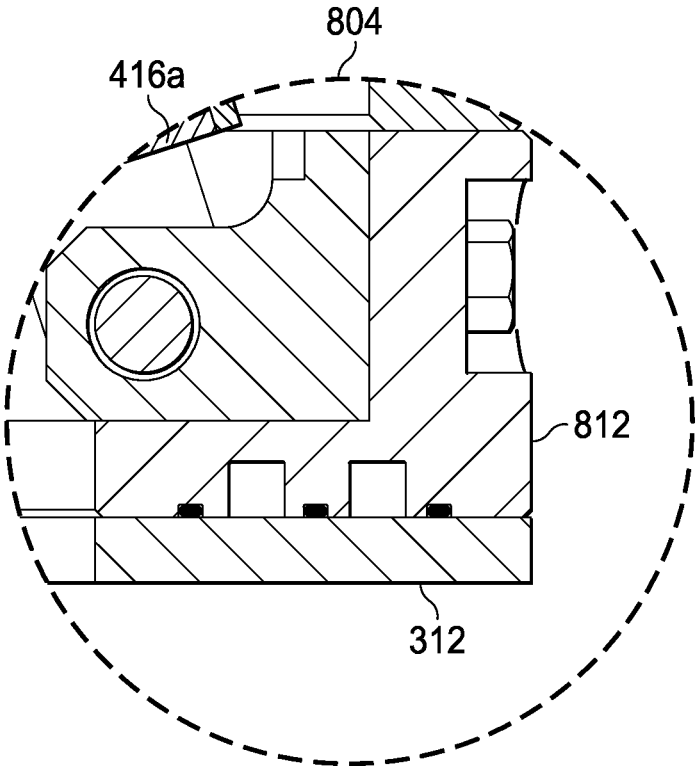
FIG. 8D is a schematic of a portion of an exemplary tubular retention system in operation according to one or more aspects of the present disclosure.

FIGS. 8C and 8D are detailed views 806 and 804, respectively, showing portions of the exemplary tubular retention system 300 in operation according to one or more aspects of the present disclosure. Specifically, FIG. 8C shows a detailed view of the upper region of the load bearing plate 408*a* and upper section of the die 414*a*. As discussed above with respect to FIGS. 4 and 5, the die 414*a* is removably coupled to the system, held in place by die pin 420*a*. The die pin 420*a* may be spring loaded by die spring 810*a* to enable quick removal of the die 414*a* and replacement with a new die 414*a* should such become necessary or desired, for example by pressing down on the die pin 420*a* with sufficient force to overcome the upward force of the die spring 810*a*. Although discussed with respect to die 414*a* specifically, corresponding details exist with respect to the other dies 414*b*-414*d* according to the exemplary embodiments of FIGS. 4 and 5.

FIG. 8D shows a detailed view of a region of where the external support structure 302 meets the base 312. Specifically, FIG. 8D shows a detailed view of an embodiment where the actuators 416*a*-416*d* are hydraulic cylinders. FIG. 8D shows a hydraulic manifold block 812 that regulates the fluid flow between the actuators 416*a*-416*d* and one or more pumps not shown.

Figure 9:
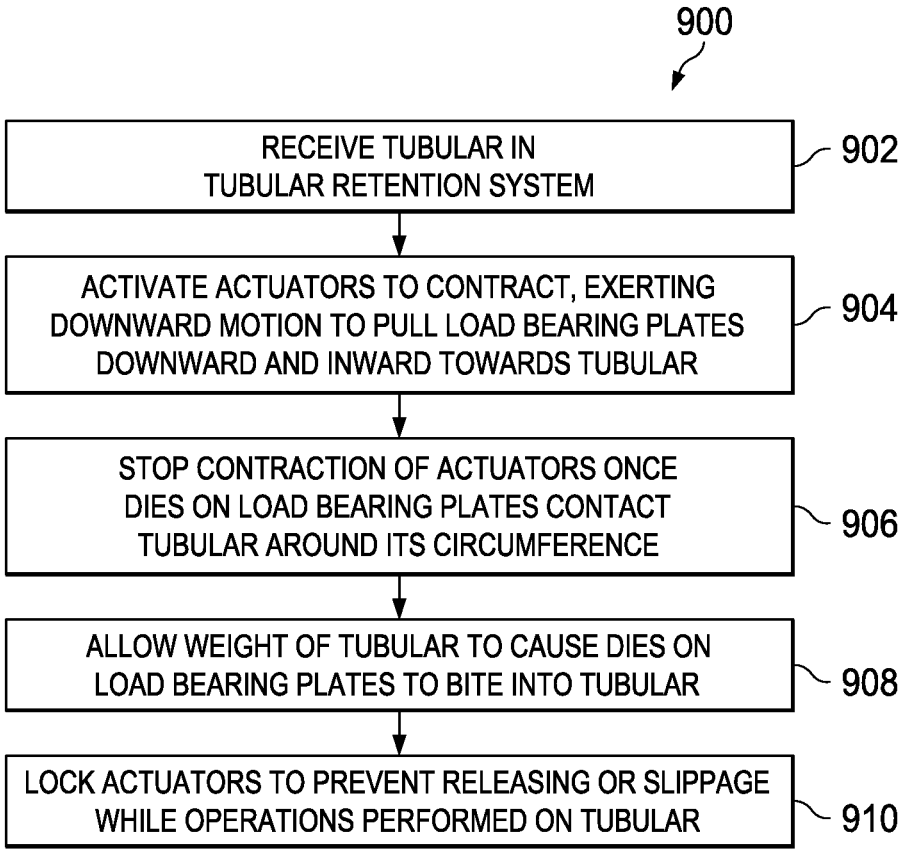
FIG. 9 is an exemplary flowchart of a process for securing a tubular in an exemplary tubular retention system according to one or more aspects of the present disclosure.

FIG. 9 is a flow chart showing an exemplary process 900 for engaging and securing a tubular within an exemplary tubular retention system according to aspects of the present disclosure. The process 900 may be performed, for example, by the exemplary tubular retention system 300 discussed above with respect to FIGS. 4-8D.

At step 902, the tubular retention system 300 receives a tubular. For example, the tubular retention system 300 may receive a tubular such as tubular 702 or 802. The tubular may have a diameter in the range of about 2 to 18 inches, or some other diameter. The tubular is inserted into the open center 401 while the tubular retention system 300 is in an "open" position, as a result of the upward-biasing force of the biasing elements 418*a*-418*d* and no greater downward force from the actuators 416. The biasing elements 418 bias the tubular retention system to the open position.

At step 904, the actuators 416*a*-416*d* are activated to contract, exerting a downward force sufficient to overcome the upward-biasing force of the biasing elements 418. The load bearing plates 408 move downward and outward toward the open center 401 in response to this downward force.

At step 906, the actuators 416*a*-416*d* travel until the dies 414*a*-414*d* engage the tubular in the open center 401. As a result, the downward and radially inward movement stops. The movement of the load bearing plates 408*a*-408*d* may be synchronized by the lifting ring 422. Further, the movement of the load bearing plates 408*a*-408*d* causes the bottom portions of deflector plates 406*a*-406*d* to move downward and outward as well. As the bottom portions of the deflector plates 406*a*-406*d* move downward and outward, the top portions of the deflector plates 406*a*-406*d* slide along the track 402 (one provided for each deflector plate 406*a*-406*d* though not labeled expressly as such in FIG. 4A) to allow the deflector plates 406*a*-406*d* to decrease the operative size of the open center 401. This provides a mutually opposing centering force to the tubular until the tubular is engaged by the dies 414*a*-414*d*.

At step 908, the weight of the tubular causes the dies 414*a*-414*d*, which are already in initial contact with the surface of the tubular, to bite tighter into the tubulars until movement of the load bearing plates 408*a*-408*d* is stopped.

At step 910, the actuators 416*a*-416*d* are locked to prevent releasing or slippage in cooperation with the weight of the tubular itself bearing on the dies 414*a*-414*d*, as transferred to the external support structure 302 via the upper links 410*a*-410*d* and lower links 412*a*-412*d*. Locking may occur simply by closing fluidic valves so that the pistons cannot advance or retract. With the tubular locked in place, operations may then be performed on the tubular, such as the addition or removal of other tubulars.

Figure 10:
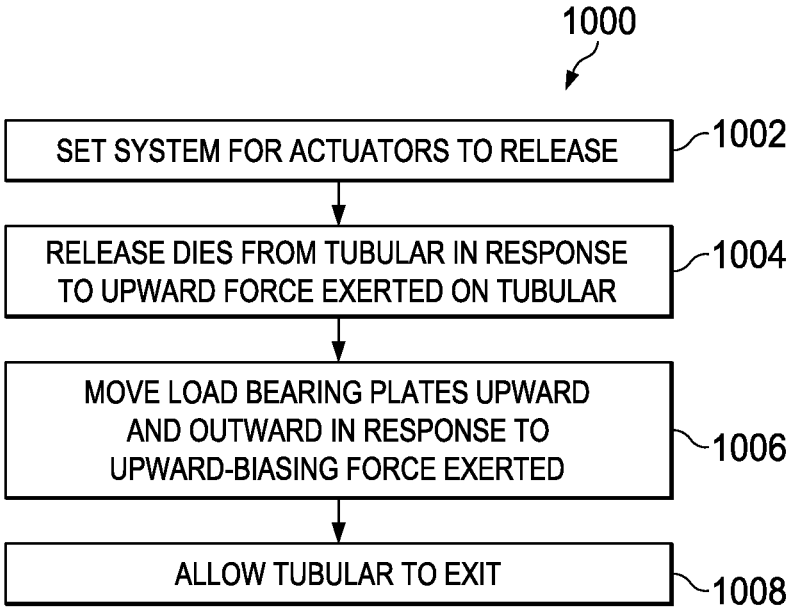
FIG. 10 is an exemplary flowchart of a process for releasing a tubular in an exemplary tubular retention system according to one or more aspects of the present disclosure.

The discussion now turns to FIG. 10, which illustrates an exemplary flowchart of a process 1000 for releasing a tubular in an exemplary tubular retention system according to one or more aspects of the present disclosure. The process 1000 may be performed, for example, by the exemplary tubular retention system 300 discussed above with respect to FIGS. 4-8D. The process may occur, for example, after completion of any operations on a tubular (e.g., addition or removal of other tubulars) having been retained according to the process 900 discussed above with respect to FIG. 9.

At step 1002, the system is set for the actuators to unlock. In embodiments where the actuators 416*a*-416*d* are hydraulic cylinders, the hydraulic system may set the hydraulic circuit to return to tank. This may accomplished manually using a switching valve. Although unlocked, the tubular typically will not slip because the weight of the tubular itself provides sufficient downward force still to hold the tubular in place against the dies 414*a*-414*d*.

At step 1004, the dies 414*a*-414*d* are released from the tubular in response to an upward force applied on the tubular. In an embodiment, this may be done by lifting the tubular with the racker device 104. This external upward force is sufficient to cause the dies 414*a*-414*d* to disengage from the tubular and thereby release it.

At step 1006, the load bearing plates 408*a*-408*d* move upward and outward in response to the upward-biasing force provided by the biasing elements 418*a*-418*d*. This movement may be synchronized, for example, by the lifting ring 422.

At step 1008, and in response to the upward-biasing force of the biasing elements 418*a*-418*d*, the load bearing plates 408*a*-408*d* lift upward and outward to further release the tubular and resume an "open" position in preparation for receiving another tubular. The tubular is allowed to exit the tubular retention system 300.

In embodiments of the present disclosure, the tubular retention system 300 may be rotatable in place relative to another tubular to assist with the make up or break down of stands. Alternatively, the tubular retention system 300 may be not rotate and instead hold a tubular stationary while another tubular is rotated to make up or break down a stand.

In view of all of the above and the figures, one of ordinary skill in the art will readily recognize that the present disclosure introduces a tubular retention system, comprising: an external support structure having a longitudinal axis and surrounding an open center configured to receive a tubular; a plurality of load bearing plates each comprising a die, the plurality of load bearing plates each being coupled to the external support structure via respective upper links and respective lower links and moveable to accommodate a plurality of tubular diameters; and an actuator system configured to impart a downward force on the plurality of load bearing plates, the plurality of load bearing plates moveable downward and inward toward a center of the external support structure in response to the downward force until each respective die engages respective surfaces of the tubular along a circumference of the tubular, a weight of the tubular being transferred via the upper and lower links of each load bearing plate to the external support structure.

The tubular retention system may include a plurality of deflector plates corresponding to the plurality of load bearing plates, each deflector plate being coupled between the external support structure and an upper portion of each respective load bearing plate and moveable in cooperation with the movement of each respective load bearing plate to center the tubular in the external support structure. The tubular retention system may also include a lifting ring associated with the plurality of load bearing plates, the lifting ring being configured to synchronize movement of the plurality of load bearing plates. The tubular retention system may also include a biasing element coupled to the lifting ring, the biasing element configured to provide an upward-biasing force to the lifting ring, wherein the upward-biasing force provided to the lifting ring causes the load bearing plates to move upward and outward in response to release of the actuator system's downward force, disengaging the dies from the circumference of the tubular for release of the tubular. In an aspect, the external support structure is coupled to a mousehole opening in a drilling rig floor. In another aspect, each of the plurality of deflector plates further comprises a spring-loaded pin configured to allow removal and replacement of the corresponding deflector plate in response to being compressed; and each of the plurality of load bearing plates further comprises a spring-loaded pin configured to allow removal and replacement of the corresponding die in response to being compressed. In another aspect, the actuator system comprises a hydraulic cylinder having a piston rod coupled to a lower portion of each respective load bearing plate, the downward force resulting from contraction of the piston rod of the hydraulic cylinder. In yet another aspect, the external support structure comprises a cylindrical shape having the open center, and the plurality of load bearing plates further comprises four load bearing plates situated along an inner circumference of the external support structure at 90 degree intervals.

The present disclosure also introduces a tubular retention system, comprising: an external support structure surrounding an open center configured to receive a tubular; a plurality of load bearing plates movable to accommodate a plurality of tubular diameters, each load bearing plate comprising a die configured to engage respective surfaces of the tubular along a circumference of the tubular; an upper link coupled to an upper portion of each load bearing plate at a first end of the upper link and a first section of the external support structure at a second end; and a lower link coupled to a lower portion of each load bearing plate at a first end of the lower link and a second section below the first section of the external support structure at a second end of the lower link, each upper link, lower link, inside surface of the external support structure, and load bearing plate forming approximately a parallelogram in relation to each other, the lengths of the upper and lower links being sized so that a weight of the tubular being transferred via the upper and lower links of each load bearing plate to the external support structure.

The tubular retention system may include a deflector plate coupled to the upper portion of each load bearing plate at a lower end of the deflector plate and coupled to a third section above the first section of the external support structure at an upper end of the deflector plate, the lower end of each deflector plate being configured to extend toward a center region of the external support structure to center the tubular in the external support structure in response to downward and inward movement of the plurality of load bearing plates. The tubular retention system may also include a lifting ring coupled between the external support structure and the upper link coupled to each load bearing plate, the lifting ring being configured to synchronize movement of the plurality of load bearing plates. The tubular retention system may also include a biasing element coupled to the lifting ring, the biasing element configured to provide an upward-biasing force to the lifting ring, wherein the upward-biasing force provided to the lifting ring causes the load bearing plates to move upward and outward in response to release of an actuator system's downward force, disengaging the dies from the circumference of the tubular for release of the tubular. The tubular retention system may also include a hydraulic cylinder comprising a piston rod configured to impart a downward force on the plurality of load bearing plates, the plurality of load bearing plates moving downward and inward toward a center of the external support structure in response to the downward force until each respective die engages the respective surfaces of the tubular along the circumference of the tubular. In an aspect, in a first position, the piston rod is fully extended and the plurality of load bearing links are extended upward and outward from the open center, ready to receive the tubular; in a second position, the plurality of load bearing links are partially drawn downward and inward in response to the downward force from the piston rod retracting and are in contact with a tubular having a first diameter; and in a third position, the plurality of load bearing links are further drawn downward and inward beyond the second position in response to additional downward force from the piston rod retracting and are in contact with a tubular having a second diameter, the second diameter being less than the first diameter. In another aspect, the external support structure is coupled to a mousehole opening in a drilling rig floor.

The present disclosure also introduces a method for retaining a tubular having any one of a plurality of diameters, comprising: receiving the tubular in an open center of an external support structure; exerting, by an actuator system, a downward force on a plurality of load bearing plates coupled via upper and lower links to the external support structure, the plurality of load bearing plates moveable downward and inward toward the tubular at the open center of the external support structure in response to the downward force to accommodate the plurality of tubular diameters; engaging, by a die on each respective load bearing plate, respective surfaces of the tubular along a circumference of the tubular in response to the downward and inward movement; and maintaining the tubular in place by transferring a weight of the tubular via the upper and lower links to the external support structure.

The method for retaining a tubular may include synchronizing movement of the plurality of load bearing plates with a lifting ring that is coupled between the external support structure and the upper link coupled to each load bearing plate. The method may also include providing an upward-biasing force to the lifting ring via a biasing element coupled to the lifting ring. The method may also include stopping the downward force at the motion inducing system; disengaging, in response to the stopping and exertion of an external upward force on the tubular, the die on each respective load bearing plate from the tubular for release of the tubular; and moving the plurality of load bearing plates upward and outward in response to the upward-biasing force of the biasing element. The method may also include centering, by a plurality of deflector plates coupled between corresponding load bearing plates and the external support structure, the tubular in the open center of the external support structure in response to downward and inward movement of the plurality of load bearing plates.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112(f) for any limitations of any of the claims herein, except for those in which the claim expressly uses the word "means" together with an associated function.

What is claimed is:

1. A tubular retention system, comprising:

an external support structure having a longitudinal axis and surrounding an open center configured to receive a tubular;

a plurality of load bearing plates each comprising a die, the plurality of load bearing plates each being coupled to the external support structure via respective upper links and respective lower links and moveable to accommodate a plurality of tubular diameters, each upper link being connected to an upper portion of each one of the plurality of load bearing plates, each lower link being connected, separately from the upper link, to a lower portion of each one of the plurality of load bearing plates; and a biasing system configured to impart a force on the plurality of load bearing plates, the plurality of load bearing plates moveable relatively inward toward a center of the external support structure in response to the force until each respective die engages respective surfaces of the tubular along a circumference of the tubular, a weight of the tubular being transferred via the upper and lower links of each load bearing plate to the external support structure.

2. The tubular retention system of claim 1, further comprising:

a plurality of deflector plates corresponding to the plurality of load bearing plates, each deflector plate being coupled between the external support structure and an upper portion of each respective load bearing plate and moveable in cooperation with the movement of each respective load bearing plate to center the tubular in the external support structure.

3. The tubular retention system of claim 2, wherein:

each of the plurality of deflector plates further comprises a spring-loaded pin configured to allow removal and replacement of the corresponding deflector plate in response to being compressed; and each of the plurality of load bearing plates further comprises a spring-loaded pin configured to allow removal and replacement of the corresponding die in response to being compressed.

4. The tubular retention system of claim 1, further comprising:

a lifting ring associated with the plurality of load bearing plates, the lifting ring being configured to synchronize movement of the plurality of load bearing plates.

5. The tubular retention system of claim 4, wherein the biasing system comprises an actuator system, the tubular retention system further comprising:

a biasing element coupled to the lifting ring, the biasing element configured to provide an upward-biasing force to the lifting ring, wherein the upward-biasing force provided to the lifting ring causes the load bearing plates to move upward and outward in response to release of the actuator system's downward force, disengaging the dies from the circumference of the tubular for release of the tubular.

6. The tubular retention system of claim 4, wherein the biasing system comprises a biasing element coupled to the lifting ring, the tubular retention system further comprising:

an actuator system coupled to at least one of the plurality of load bearing plates and configured to provide an upward force, wherein the upward force causes the plurality of load bearing plates, synchronized by the lifting ring, to move upward and outward.

7. The tubular retention system of claim 1, wherein the external support structure is coupled to a mousehole opening in a drilling rig floor.

8. The tubular retention system of claim 1, wherein:

the external support structure comprises a cylindrical shape having the open center, and the plurality of load bearing plates further comprises four load bearing plates situated along an inner circumference of the external support structure at 90 degree intervals.

9. A tubular retention system, comprising:

an external support structure surrounding an open center configured to receive a tubular;

a plurality of load bearing plates movable to accommodate a plurality of tubular diameters, each load bearing plate comprising a die configured to engage respective surfaces of the tubular along a circumference of the tubular;

an upper link coupled to an upper portion of each load bearing plate at a first end of the upper link and a first section of the external support structure at a second end; and a lower link coupled separately from the upper link to a lower portion of each load bearing plate at a first end of the lower link and a second section below the first section of the external support structure at a second end of the lower link, each upper link, lower link, inside surface of the external support structure, and load bearing plate forming approximately a parallelogram in relation to each other, the lengths of the upper and lower links being sized so that a weight of the tubular being transferred via the upper and lower links of each load bearing plate to the external support structure.

10. The tubular retention system of claim 9, further comprising:

a deflector plate coupled to the upper portion of each load bearing plate at a lower end of the deflector plate and coupled to a third section above the first section of the external support structure at an upper end of the deflector plate, the lower end of each deflector plate being configured to extend toward a center region of the external support structure to center the tubular in the external support structure in response to downward and inward movement of the plurality of load bearing plates.

11. The tubular retention system of claim 9, further comprising:

a lifting ring coupled between the external support structure and the upper link coupled to each load bearing plate, the lifting ring being configured to synchronize movement of the plurality of load bearing plates.

12. The tubular retention system of claim 11, further comprising:

a biasing element coupled to the lifting ring, the biasing element configured to provide an upward-biasing force to the lifting ring, wherein the upward-biasing force provided to the lifting ring causes the load bearing plates to move upward and outward in response to release of an actuator system's downward force, disengaging the dies from the circumference of the tubular for release of the tubular.

13. The tubular retention system of claim 11, further comprising:

a biasing element coupled to the lifting ring and configured to provide a downward-biasing force to the lifting ring that causes the load bearing plates to move downward and inward to engage the respective surfaces of the tubular; and an actuator system coupled to at least one of the load bearing plates and configured to provide an upward force that overcomes the downward-biasing force and causes the plurality of load bearing plates, synchronized by the lifting ring, to move upward and outward.

14. The tubular retention system of claim 9, further comprising:

a hydraulic cylinder comprising a piston rod configured to impart a downward force on the plurality of load bearing plates, the plurality of load bearing plates moving downward and inward toward a center of the external support structure in response to the downward force until each respective die engages the respective surfaces of the tubular along the circumference of the tubular.

15. The tubular retention system of claim 14, wherein:

in a first position, the piston rod is fully extended and the plurality of load bearing links are extended upward and outward from the open center, ready to receive the tubular;

in a second position, the plurality of load bearing links are partially drawn downward and inward in response to the downward force from the piston rod retracting and are in contact with a tubular having a first diameter; and in a third position, the plurality of load bearing links are further drawn downward and inward beyond the second position in response to additional downward force from the piston rod retracting and are in contact with a tubular having a second diameter, the second diameter being less than the first diameter.

16. A method for retaining a tubular having any one of a plurality of diameters, comprising:

receiving the tubular in an open center of an external support structure;

exerting, by a biasing system, a force on a plurality of load bearing plates coupled via upper and lower links to the external support structure, each upper link being connected to an upper portion of each one of the plurality of load bearing plates, each lower link being connected, separately from the upper link, to a lower portion of each one of the plurality of load bearing plates, the plurality of load bearing plates moveable relatively inward toward the tubular at the open center of the external support structure in response to the downward force to accommodate the plurality of tubular diameters;

engaging, by a die on each respective load bearing plate, respective surfaces of the tubular along a circumference of the tubular in response to the downward and inward movement; and maintaining the tubular in place by transferring a weight of the tubular via the upper and lower links to the external support structure.

17. The method of claim 16, further comprising:

synchronizing movement of the plurality of load bearing plates with a lifting ring that is coupled between the external support structure and the upper link coupled to each load bearing plate.

18. The method of claim 17, wherein the biasing system comprises an actuator system, the method further comprising:

providing an upward-biasing force to the lifting ring via a biasing element coupled to the lifting ring; and providing the force by the actuator system to overcome the upward-biasing force and move the load bearing plates relatively inward to engage the tubular.

19. The method of claim 18, further comprising:

stopping the force at the motion inducing system;

disengaging, in response to the stopping and exertion of an external upward force on the tubular, the die on each respective load bearing plate from the tubular for release of the tubular; and moving the plurality of load bearing plates upward and outward in response to the upward-biasing force of the biasing element.

20. The method of claim 17, wherein the biasing system comprises a biasing element coupled to the lifting ring, the method further comprising:

providing the force to the lifting ring via the biasing element;

providing an upward force by an actuator system to at least one of the plurality of load bearing plates that overcomes the force; and disengaging the die on each respective load bearing plate from the tubular in response to the actuator system's providing the upward force as the plurality of load bearing plates, synchronized by the lifting ring, move upward and outward.

* * * * *